US007926904B2

(12) United States Patent
Kojima

(10) Patent No.: US 7,926,904 B2
(45) Date of Patent: Apr. 19, 2011

(54) INKJET RECORDING APPARATUS AND CLEANING METHOD

(75) Inventor: Toshiya Kojima, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 680 days.

(21) Appl. No.: 11/905,124

(22) Filed: Sep. 27, 2007

(65) Prior Publication Data

US 2008/0079772 A1 Apr. 3, 2008

(30) Foreign Application Priority Data

Sep. 28, 2006 (JP) ..... 2006-265494

(51) Int. Cl.
*B41J 2/165* (2006.01)

(52) U.S. Cl. ..... 347/35

(58) Field of Classification Search ..... None
See application file for complete search history.

(56) References Cited

U.S. PATENT DOCUMENTS 5,640,655 A * 6/1997 Shoji ..... 399/249
6,328,411 B1 * 12/2001 Taylor et al. ..... 347/29
6,932,455 B2 * 8/2005 Monclus et al. ..... 347/22
7,001,009 B2 * 2/2006 Sakurai ..... 347/33
2006/0061619 A1 * 3/2006 Gast et al. ..... 347/31

FOREIGN PATENT DOCUMENTS

JP 5-261903 A 10/1993
JP 8-39828 A 2/1996

* cited by examiner

*Primary Examiner* — Matthew Luu
*Assistant Examiner* — Alejandro Valencia
(74) *Attorney, Agent, or Firm* — Birch, Stewart, Kolasch & Birch, LLP

(57) ABSTRACT

An inkjet recording apparatus that includes an intermediate transfer body that has an image forming surface including an image forming region on which an image is formed by means of the ink droplets ejected from an ink ejection head and a cleaning device which makes contact with the image forming surface of the intermediate transfer body to wipe off and remove adhering material attached to the intermediate transfer body. A second cleaning device makes contact with the first cleaning device to remove adhering material attached to the first cleaning device. An ejection control device controls ink ejection from the head and a recovery device is provided which recovers the adhering material removed by the second cleaning device.

12 Claims, 19 Drawing Sheets

INKJET RECORDING APPARATUS AND CLEANING METHOD

BACKGROUND OF THE INVENTION

1. Field of the Invention

The present invention relates to an inkjet recording apparatus and a cleaning method, and more particularly, to a technology of cleaning an intermediate transfer body in an inkjet recording apparatus which uses the intermediate transfer body, whereby ink and foreign matter remaining on the intermediate transfer body are removed with reducing the cost of consumables or the like.

2. Description of the Related Art

There are inkjet recording apparatuses which use an intermediate transfer system in which an image is formed on an intermediate transfer body by means of ink ejected from a recording head, and then the image on the intermediate transfer body is transferred to a recording medium. In an intermediate transfer system, when printing a full face image in which an image is recorded onto the whole surface of the recording medium without leaving borders, the image is also formed to the outside of the region corresponding to the recording medium, and therefore ink may be left on the intermediate transfer body after transfer to the recording medium. Furthermore, it may also happen that ink is left on the intermediate transfer body rather than being transferred to the recording medium, due to insufficient pressing force during transfer, or the like. There is a possibility that the presence of residual ink of this kind may affect image quality, and therefore it is necessary to remove the residual ink from the intermediate transfer body before forming the next image. In general, the method of removing foreign matter from the intermediate transfer body uses a method where the foreign matter on the intermediate transfer body is wiped away by means of a wiping member, such as a blade or a web member, or a method where the intermediate transfer body is cleaned by using a cleaning solution.

Japanese Patent Application Publication No. 5-261903 discloses a transfer type of inkjet recording apparatus in which liquid on the surface of a transfer drum is moved to the end portions of the transfer drum via guide grooves provided in a spiral fashion about the outer circumference of the transfer drum, the liquid then being recovered into a recovery tank via grooves provided in the end portions of the drum.

Furthermore, Japanese Patent Application Publication No. 8-39828 discloses an inkjet recording apparatus comprising an inkjet recording device in which a blade member is provided to one side of the ink ejection section, at a position adjacent to the side face of the ink ejection section and separated by a small gap from same, and when cleaning of the ink ejection section is carried out by wiping the cleaning blade over the ink ejection section, the cleaning blade makes contact with the front tip portion of a plate member and ink or foreign matter attached to the cleaning blade is removed by the front tip portion of the plate member.

However, in a method which wipes an intermediate transfer body by means of a blade, foreign matter accumulates on the blade and it becomes necessary to recover the foreign matter attached to the blade and to clean the blade, at periodic intervals. The method described in Japanese Patent Application Publication No. 8-39828 is conceivable as a method of cleaning the blade, but Japanese Patent Application Publication No. 8-39828 makes no mention of a method for recovering foreign matter which has been removed from the blade, and there is a concern that foreign matter or ink accumulated on the plate member or in the gaps may fall onto the image, thereby degrading image quality. In particular, if using an ink which has become highly viscous due to evaporation of the solvent, or if using an ink which has an essential high viscosity, the ink is liable to remain on the front tip portion of the plate member, and possibilities, such as residual ink falling off onto the image and becoming reattached to the blade, can be envisaged.

In a method which wipes an intermediate transfer body by means of a web member, there is a possibility of increased costs since the web is a consumable item, and in a method which cleans the intermediate transfer body by means of a cleaning solution, it is necessary to recover the cleaning solution, and furthermore, the cleaning solution is also a consumable item.

Japanese Patent Application Publication No. 5-261903 states that the ink collected between a removal roller and a transfer drum is held by the edge portions of a guide groove, but if soiling is adhering to the removal roller or the transfer drum, or if an ink of high viscosity is being used, or if the rotational speed of the transfer drum is high in a case where high-speed printing is being carried out, or the like, then a situation may occur in which the ink is not held by the edge portions of the guide grooves and the solvent adheres to the transfer drum again. In other words, a portion of the ink in the state of a meniscus formed between the removal roller and the transfer roller passes beyond the removal roller and remains on the transfer drum, and this may give rise to degradation of the image quality by mixing with subsequently ejected droplets of ink.

SUMMARY OF THE INVENTION

The present invention has been contrived in view of these circumstances, an object thereof being to provide an inkjet recording apparatus and a cleaning method whereby ink and foreign matter remaining on an intermediate transfer body can be removed efficiently and reliably, without increasing costs due to consumables or the like.

In order to attain the aforementioned object, the present invention is directed to an inkjet recording apparatus comprising: a head which ejects ink droplets; an intermediate transfer body that has an image forming surface including an image forming region on which an image is formed by means of the ink droplets ejected from the head; a movement device which moves the intermediate transfer body in a movement direction; a transfer device which transfers the image formed on the image forming region of the intermediate transfer body to a recording medium; a first cleaning device which is provided in a breadthways direction of the intermediate transfer body that is perpendicular to the movement direction, on an upstream side of the head in terms of the movement direction, and which makes contact with the image forming surface of the intermediate transfer body to wipe off and remove adhering material attached to the intermediate transfer body; a first groove which is provided in the image forming surface of the intermediate transfer body in a direction forming a prescribed angle of $\alpha$(where $0° < \alpha < 90°$) with respect to the breadthways direction of the intermediate transfer body, has a length corresponding to a length of the first cleaning device in a direction perpendicular to the movement direction, and has an opening in one end section of the intermediate transfer body in the breadthways direction; a second cleaning device provided inside the first groove in a direction in which the first groove is formed, throughout the length of the first cleaning device in the direction perpendicular to the movement direction, and making contact with the first cleaning device to remove adhering material attached to the first cleaning device; an ejection control device which controls ink ejection from the head in such a manner that preliminary ejection is carried out from the head toward the second cleaning device to cause adhering material attached to the second cleaning device to flow into the first groove; and a recovery device which is provided on a downstream side of the head in terms of the movement direction, and which recovers the adhering material removed by the second cleaning device and collected in the first groove, via the opening of the first groove.

In this aspect of the present invention, adhering material attached to the first cleaning device is removed by causing the second cleaning device to make contact with the first cleaning device, preliminary ejection is carried out toward the second cleaning device thereby causing the adhering material attached to the second cleaning device to flow into the first groove, and furthermore, a composition is adopted in which the adhering material collected inside the first groove is recovered in the recovery device outside the intermediate transfer body. Therefore, the adhering material removed from the first cleaning device is recovered efficiently into the recovery device via the second cleaning device and the groove. Furthermore, since the adhering material attached to the second cleaning device is caused to flow into the first groove by means of the ink droplets ejected from the head by means of the preliminary ejection operation, then the adhering material is prevented from become reattached to the first cleaning device from the second cleaning device, and furthermore, consumables for the cleaning of the second cleaning device are not produced.

A desirable mode is one in which the first cleaning device comprises one wiping member which has a length corresponding to the full width of the intermediate transfer body. Furthermore, it is also possible to arrange short wiping members, each of a length that is shorter than the full width of the intermediate transfer body, through the full width of the intermediate transfer body, or to scan (move) a short wiping member through the full width of the intermediate transfer body.

A desirable mode is one in which the second cleaning device comprises one wiping member having a length corresponding to the length of the first cleaning device in the direction perpendicular to the direction of movement (in other words, the lengthwise direction of the first cleaning device). Furthermore, it is also possible to arrange short wiping members, each having a length that is shorter than the length of the first cleaning device in the lengthwise direction, through the full length of the first cleaning device in the lengthwise direction, or to scan (move) a short cleaning member though the full width of the first cleaning device in the lengthwise direction thereof.

A desirable mode is one in which an opening and closing member is provided in the opening of the first groove, and an opening and closing control device is also provided in order to control the opening and closing member in such a manner that the opening section is opened when expelling the ink collected inside the first groove, to the recovery device.

Preferably, the first groove includes a straight section having a substantially linear form in a substantially perpendicular direction from the image forming surface of the intermediate transfer body and having a recess section provided in a bottom face of the straight section, and an undercut section connected to the straight section and formed in a direction that is substantially perpendicular to a direction in which the straight section is formed; and the recess section and the undercut section are formed in such a manner that, during the intermediate transfer being moved, ink in the first groove is retained in at least one of the recess section and the undercut section.

According to this aspect of the invention, since the ink inside the first groove is retained in the undercut section during movement of the intermediate transfer body, then leakage from the first groove is prevented. In this aspect of the invention, particularly notable effects are exerted in a mode where a drum-shaped intermediate transfer body is used and the first groove is rotated.

Preferably, the inkjet recording apparatus further comprises a restrictor plate provided on an inner wall face of the straight section of the first groove.

According to this aspect of the invention, by providing the restrictor plate in the straight section, it is possible to prevent the occurrence of leaks caused by the ink inside the first groove flowing back along the straight section.

A desirable mode is one in which the restrictor plate is provided in an inclined fashion on the inner wall of the first groove.

Preferably, the inkjet recording apparatus further comprises a second groove which is provided in a bottom face of the first groove and has a smaller width than a width of the first groove in a direction perpendicular to the direction in which the first groove is formed.

According to this aspect of the invention, the ink inside the first groove is retained by the second groove and therefore it is possible to prevent leaks from the first groove.

The second groove may be formed in parallel with the direction in which the first groove is formed, or they may be formed in a direction that creates a prescribed angle with respect to the direction in which the first groove is formed. Furthermore, it is also possible to combine a plurality of grooves formed in different directions.

Preferably, the inkjet recording apparatus further comprises a biasing device which presses the first cleaning device against the image forming surface of the intermediate transfer body to deform the first cleaning device, in such a manner that relationship between a length $d_0$ in the movement direction of the first groove and a length $d_1$ in the movement direction of a portion of the first cleaning device which makes contact with the intermediate transfer body satisfies $d_0>d_1$.

According to this aspect of the invention, it is possible to make the first cleaning device contact the intermediate transfer body in a reliable fashion, by causing the first cleaning device to undergo elastic deformation in such a manner that the first cleaning device makes contact with the image forming surface of the intermediate transfer body. Moreover, by satisfying the relationship $d_0>d_1$ between the length $d_0$ of the first groove in the direction of movement and the length $d_1$ of the portion of the first cleaning device which makes contact with the intermediate transfer body, in the direction of movement, then it is possible for the first cleaning device to be restored from the elastic deformation and enter reliably into the first groove, and it is also possible to achieve reliable contact between the first cleaning device and the second cleaning device.

Preferably, the first cleaning device is arranged obliquely at a prescribed angle with respect to the direction in which the first groove is formed.

According to this aspect of the invention, by providing the first cleaning device in an oblique fashion with respect to the direction in which the first groove is formed (in other words, the direction in which the second cleaning device is provided), it is possible to make the second cleaning device come into contact with the first cleaning device successively, from one end toward the other end of the first cleaning device, and therefore the occurrence of any unwiped areas on the first cleaning device can be prevented.

In order to attain the aforementioned object, the present invention is also directed to a cleaning method comprising: an image forming step of forming an image on an image forming region of an image forming surface of an intermediate transfer body by means of ink ejected from a head; a movement step of moving the intermediate transfer body in a moving direction; a transfer step of transferring the image formed on the image forming region of the intermediate transfer body to a recording medium; a first cleaning step of causing a first cleaning device to make contact with the image forming surface of the intermediate transfer body to wipe off and remove adhering material attached to the intermediate transfer body, the first cleaning device being provided in a breadthways direction of the intermediate transfer body that is perpendicular to the movement direction on an upstream side of the head in terms of the movement direction; a second cleaning step of causing a second cleaning device to make contact with the first cleaning device to remove adhering material attached to the first cleaning device, the second cleaning device having a length corresponding to a length of the first cleaning device in a direction perpendicular to the movement direction and being provided in a first groove in a direction in which the first groove is formed, the first groove being provided in the image forming surface of the intermediate transfer body in a direction forming a prescribed angle of $\alpha$(where $0° < \alpha < 90°$) with respect to the breadthways direction of the intermediate transfer body, having a length corresponding to the length of the first cleaning device in the direction perpendicular to the movement direction, and having an opening in one end section of the intermediate transfer body in the breadthways direction; a preliminary ejection step of ejecting ink droplets from the head onto the second cleaning device to cause adhering material attached to the second cleaning device to flow into the first groove; and a recovery step of recovering the adhering material removed by the second cleaning device and collected in the first groove, via the opening of the first groove, by means of a recovery device provided on a downstream side of the head in terms of the movement direction.

According to the present invention, adhering material attached to the first cleaning device is removed by causing the second cleaning device to make contact with the first cleaning device, preliminary ejection is carried out toward the second cleaning device thereby causing the adhering material attached to the second cleaning device to flow into the first groove, and furthermore, a composition is adopted in which the adhering material collected inside the first groove is recovered in the recovery device outside the intermediate transfer body. Therefore, the adhering material removed from the first cleaning device is recovered efficiently into the recovery device via the second cleaning device and the groove. Furthermore, since the adhering material attached to the second cleaning device is caused to flow into the first groove by means of the ink droplets ejected from the head by means of a preliminary ejection operation, then the adhering material is prevented from become reattached to the first cleaning device from the second cleaning device, and furthermore, consumables for the cleaning of the second cleaning device are not produced.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
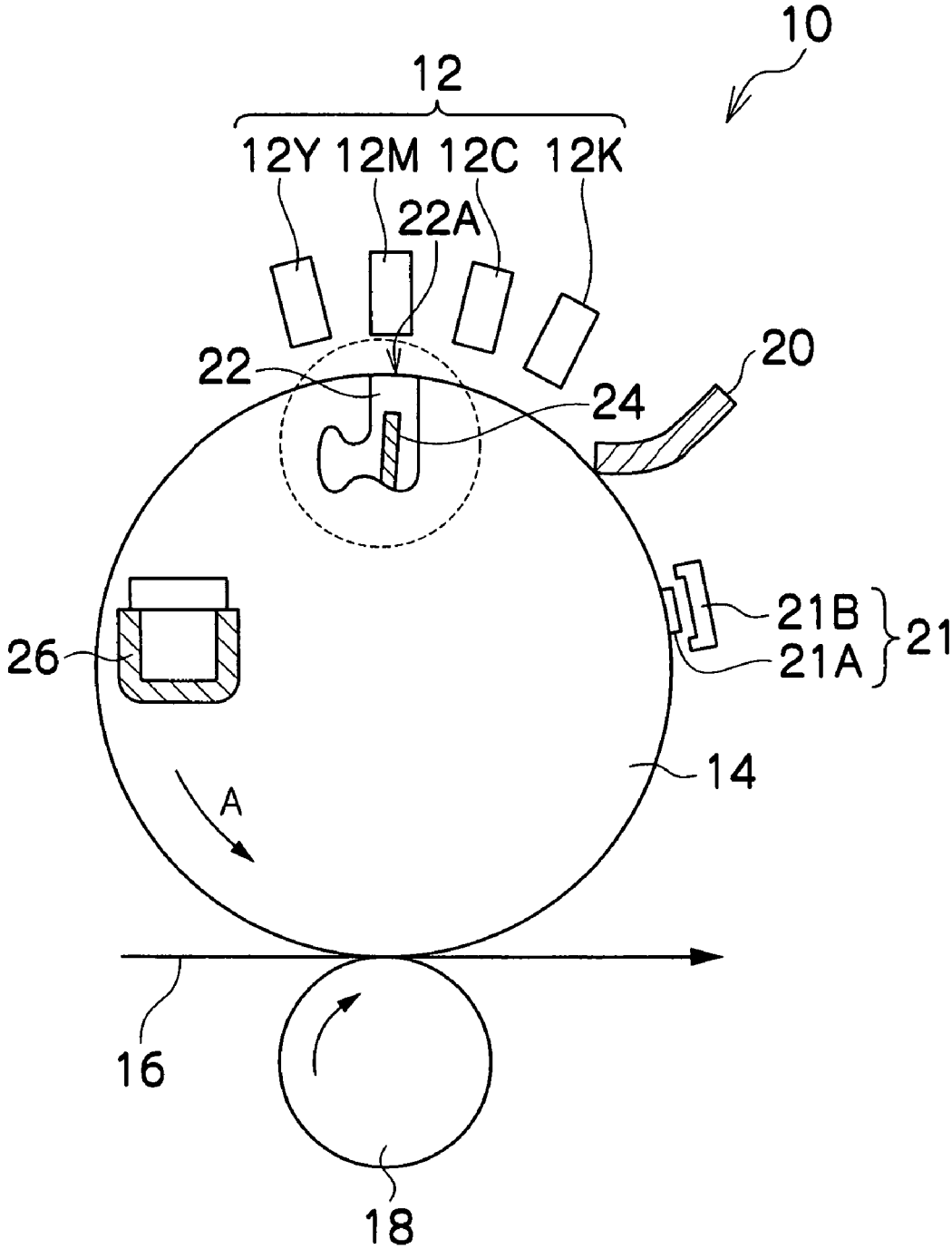
FIG. 1 is a basic schematic drawing of an inkjet recording apparatus relating to an embodiment of the present invention.

FIG. 1 is a schematic drawing showing the general composition of an example of an inkjet recording apparatus 10 relating to an embodiment of the present embodiment. As shown in FIG. 1, the inkjet recording apparatus 10 comprises: a print unit 12 having inkjet heads (hereinafter, called "heads") 12K, 12C, 12M and 12Y corresponding to the respective colors of K, C, M and Y; an intermediate transfer drum 14 (intermediate transfer body) having on the outer circumferential face thereof an image forming region (not illustrated in FIG. 1, and indicated by reference numeral 30 in FIG. 7) on which a color image is formed by means of ink ejected from the heads 12K, 12C, 12M and 12Y; a transfer roller 18 which presses a recording medium 16 by sandwiching the recording medium 16 between itself and the intermediate transfer drum 14, thereby transferring an image formed on the image forming region to the recording medium 16; and a first cleaning blade 20 which wipes away and removes ink remaining on the surface of the intermediate transfer drum 14, and adhering material, such as paper dust, that has become attached to the intermediate transfer drum 14 due to contact with the recording medium 16, after transferring the image to the recording medium 16 and before ejecting ink from the print unit 12. Furthermore, the inkjet recording apparatus 10 also comprises a position determination device 21 which determines the relative position of the intermediate transfer drum 14 on the rotational conveyance path (in other words, the relative position of the intermediate transfer drum 14 with respect to another member, such as the print unit 12).

The print unit 12 comprises the heads which eject inks corresponding to the respective colors of black (K), cyan (C), magenta (M) and yellow (Y), arranged in succession from the upstream side, in the direction of movement of the circumference surface of the intermediate transfer drum 14. Inks of respective colors are ejected in sequence from the heads 12K, 12C, 12M and 12Y while the intermediate transfer drum 14 is rotated in a prescribed direction, thereby forming a color image on the image forming region of the intermediate transfer drum 14.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

Figure 2:
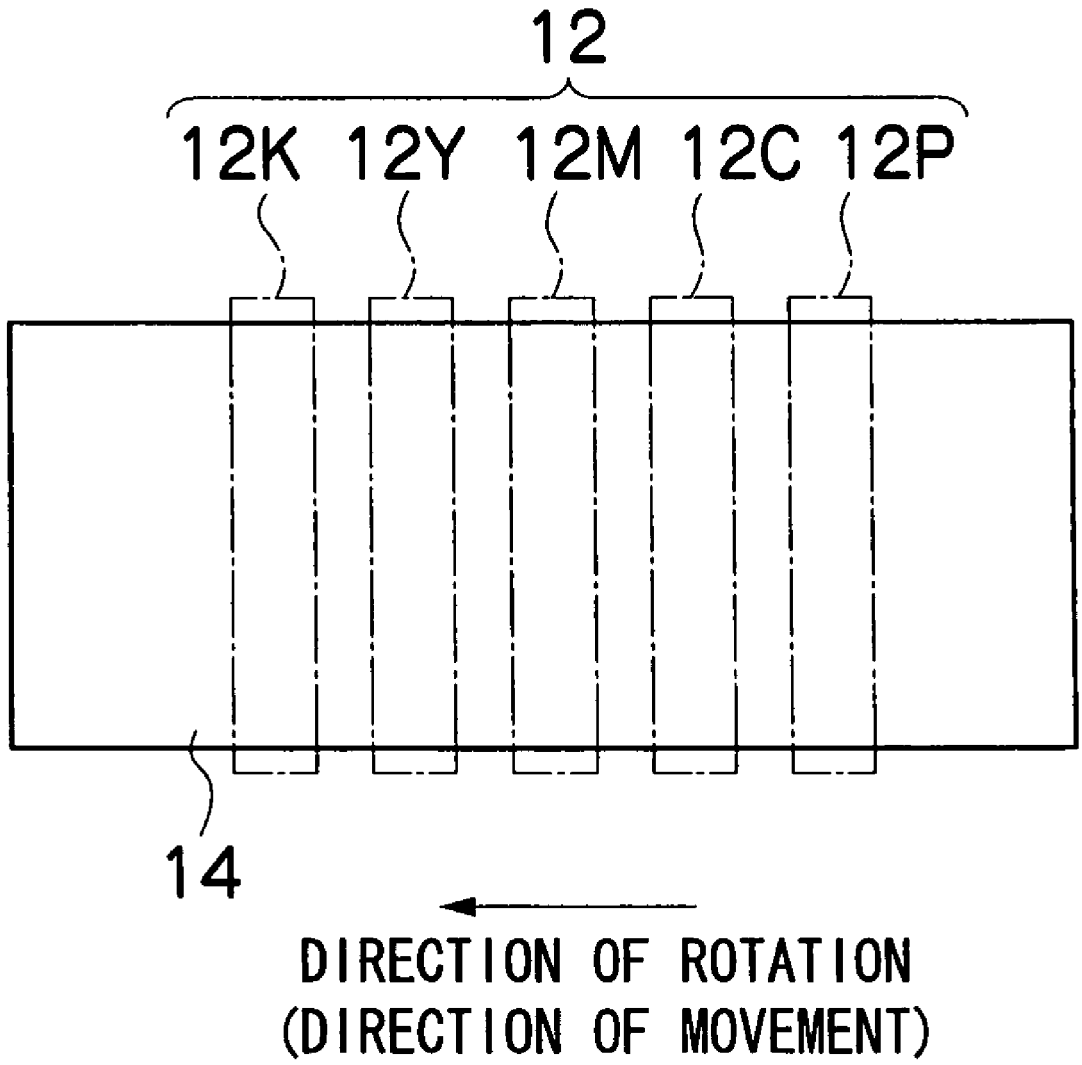
FIG. 2 is a plan view of the principal part of the peripheral printing region of the inkjet recording apparatus illustrated in FIG. 1.

As shown in FIG. 2, the heads 12K, 12C, 12M and 12Y of the print unit 12 are constituted by line heads in which a plurality of nozzles are arranged through a length which does not exceed the maximum width of the intermediate transfer drum 14 (the maximum length in a direction substantially perpendicular to the direction of movement of the intermediate transfer drum 14), and which corresponds to the width of the image forming region (not illustrated in FIG. 1 and indicated by reference numeral 30 in FIG. 7) (for example, the nozzles are arranged through a length that is equal to the width of the image forming region). In this way, by means of the full line type heads 12K, 12C, 12M and 12Y which cover the full width of the intermediate transfer drum 14, it is possible to form an image over the whole area of the image forming region of the intermediate transfer drum 14, by means of one operation of scanning the intermediate transfer drum 14 and the heads 12K, 12C, 12M and 12Y, relatively to each other, just once (in other words, by means of one operation of sub-scanning). Higher-speed printing is thereby made possible and productivity can be improved in comparison with a serial type head configuration in which a head moves reciprocally in the breadthways direction of the intermediate transfer drum 14.

The material of the intermediate transfer drum 14 may be a metal material, such as aluminum or stainless steel, or it may be an elastic material, such as rubber. Furthermore, it is also possible to compose the intermediate transfer drum 14 by bonding an elastic member made of rubber, or the like, to the surface of a metal drum. In other words, for the intermediate transfer drum 14, it is possible to select various materials, appropriately, in accordance with the fixing characteristics of the ink ejected from the inkjet heads, and the characteristics, such as transfer characteristics, required during transfer.

Figure 9:
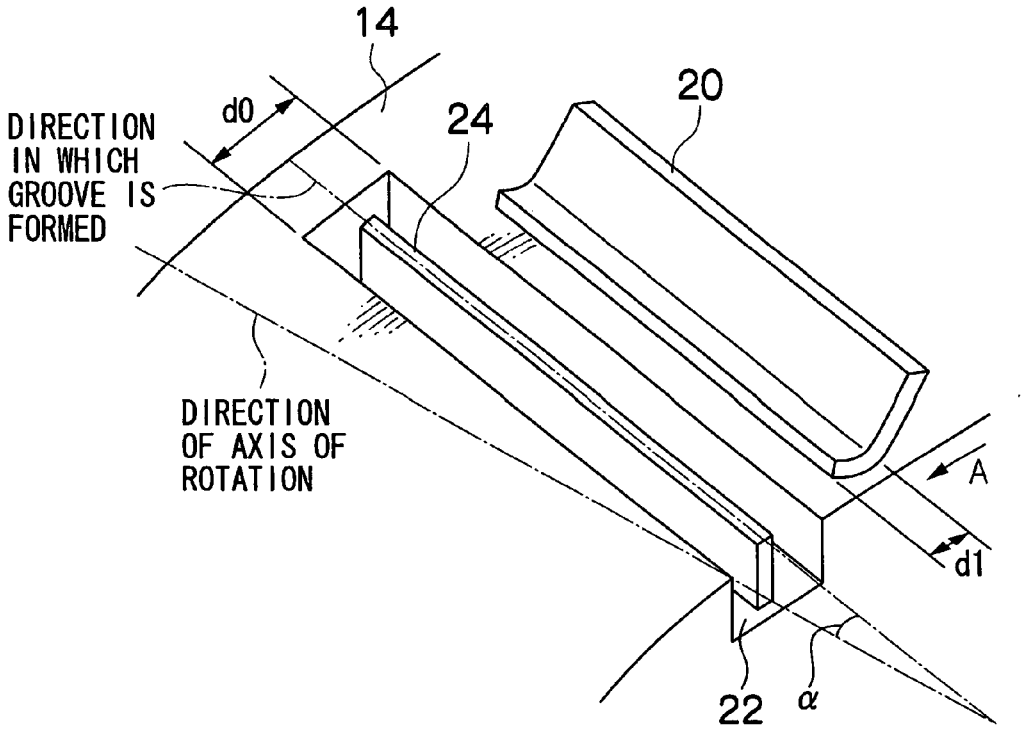
FIG. 9 is a perspective diagram showing the detailed structure of the first and second cleaning blades and the groove shown in FIG. 1.

The first cleaning blade 20 employs a member having a prescribed elasticity which deforms elastically when it is pushed against the surface of the intermediate transfer drum 14 in such a manner that it makes reliable contact with the surface of the intermediate transfer drum 14 (for example, it deforms to assume a substantially L-shaped form or a substantially J-shaped form; see FIG. 9). For the first cleaning blade 20, it is suitable to use an elastic member made of rubber, a thermoplastic elastomer, or the like.

FIG. 1 shows an example of the position determination device 21 which determines a determination piece 21A provided on the external circumference of the intermediate transfer drum 14 by means of an optical sensor 21B, but it is also possible to adopt a composition in which an encoder is attached to a motor which causes the intermediate transfer drum 14 to rotate (not shown in FIG. 1 and indicated by reference numeral 88 in FIG. 6), in such a manner that the position of the intermediate transfer drum in the rotational path is determined on the basis of the output signal from the encoder. Furthermore, FIG. 1 contains a reference numeral 21A which represents a plurality of determination pieces, but in fact a plurality of determination pieces are provided so as to correspond to the positions on the intermediate transfer drum 14 where processes are carried out, such as the image forming position, the transfer position, or the like.

The intermediate transfer drum 14 rotates in the counterclockwise direction in FIG. 1 (indicated by arrow A), and when the image forming region arrives at the ink ejection region directly below the print unit 12, then a desired image is formed on the image forming region by means of the ink droplets deposited from the print unit 12. When the image forming region on which an image has been formed moves to the transfer region where the transfer roller 18 is provided, in accordance with the rotation of the intermediate transfer drum 14, the recording medium 16 becomes sandwiched between the intermediate transfer drum 14 and the transfer roller 18 in synchronism with the movement of the image forming region, and the recording medium 16 is pressed against the image on the intermediate transfer drum 14 by means of the transfer roller 18, thereby transferring the image to the recording medium 16.

The recording medium 16 includes media known as an image forming medium, a recording medium, an image receiving medium, and the like. For the recording medium 16, it is possible to employ various types of media, regardless of their material or shape (sheet media or continuous media), such as uncoated paper, coated paper such as art paper, a resin film such as PE (polyethylene), PET (polyethylene terephthalate), PP (polypropylene), or the like, or cloth, or other materials.

After carrying out the transfer onto the recording medium 16, ink may remain on the surface of the intermediate transfer drum 14, in the image forming region of the intermediate transfer drum 14, without moving to the recording medium 16. Particularly in the case of borderless printing (full surface image printing), there are cases where ink may adhere to areas outside the image forming region. Furthermore, adherence of paper dust, dirt, dust or other matter to the surface of the intermediate transfer drum 14 may occur. Adhering material of this kind is wiped off and removed by means of the first cleaning blade 20, which is disposed between the transfer roller 18 and the print unit 12 in the rotational path of the intermediate transfer drum 14.

The intermediate transfer drum 14 comprises a groove 22 (first groove) having an opening section 22A formed in the outer circumferential surface (front surface) in a direction that forms a prescribed angle (the angle $\alpha$ in FIG. 7) with respect to the direction of the rotational axle of the intermediate transfer drum 14 (the direction substantially perpendicular to the direction of movement of the intermediate transfer drum 14), located at a position after the image forming region.

Furthermore, a second cleaning blade 24 which wipes off and removes adhering material attached to the first cleaning blade 20 by making contact with the first cleaning blade 20 is provided on the inner side of the groove 22.

When the intermediate transfer drum 14 rotates in a prescribed direction of rotation and the image forming region passes the region where the first cleaning blade 20 is disposed, then the adhering material attached to the image forming region on the intermediate transfer drum 14 and the periphery thereof is removed by the first cleaning blade 20. Moreover, when the intermediate transfer drum 14 rotates further and the groove 22 (second cleaning blade 24) reaches the region where the first cleaning blade 20 is disposed, then the first cleaning blade 20 makes contact with the second cleaning blade 24, and the adhering material attached to the first cleaning blade 20 is removed by the second cleaning blade 24.

For the second cleaning blade 24, it is suitable to use a material such as stainless steel or another metal material, or ceramic, or the like, which has a higher rigidity than the first cleaning blade in order that it can scrape off adhering material attached to the first cleaning blade 20, as well as having excellent ink resistant properties.

Furthermore, a desirable mode is one in which narrow grooves are formed in the surface of the second cleaning blade 24 which makes contact with the first cleaning blade. In other words, when the surface of the second cleaning blade 24 in contact with the first cleaning blade makes contact with the first cleaning blade 20, it is possible to make the ink attached to the first cleaning blade 20 move to the second cleaning blade 24, by means of capillary action, and furthermore it is also possible to hold the ink that has moved from the first cleaning blade, on the second cleaning blade 24. A further desirable mode is one where, instead of forming grooves, a porous member, such as porous ceramic, is provided on the at least the portion of the second cleaning blade 24 which makes contact with the first cleaning blade 20.

When the intermediate transfer drum 14 rotates further after the adhering material attached to the first cleaning blade 20 has been scraped away from the second cleaning blade 24 in this way, and the second cleaning blade 24 arrives at the ejection region directly below the print unit 12, then preliminary ejection is carried out onto the second cleaning blade 24 from at least one head of the heads 12K, 12C, 12M and 12Y The adhering material which is attached to the second cleaning blade is made to flow to the bottom face of the groove 22 by the ink ejected in the preliminary ejection operation.

In other words, the soiling adhering to the second cleaning blade 24 is washed away by the liquid component of the ink which is deposited by the print unit 12. This is because it is considered that the ink attached to the second cleaning blade 24 may have increased in viscosity or have solidified, and therefore the purpose of the preliminary ejection operation is to make this ink of increased viscosity (or solidified ink) flow away.

Moreover, when the intermediate transfer drum rotates further and the groove 22 arrives at the position where a recovery tray 26 is disposed, then the intermediate transfer drum 14 is halted temporarily and the ink and adhering material collected in the groove 22 is recovered in the recovery tray 26. The recovery tray 26 is fixed to the outside of the intermediate transfer drum 14, and is disposed in the vicinity of one end portion of the intermediate transfer drum 14 in the direction of the axis of rotation (the breadthways direction), in the downstream side of the print unit 12. FIG. 1 shows a mode where the position at which the recovery tray 26 is disposed is a position at which the intermediate transfer drum 14 has rotated through approximately 90° in the counterclockwise direction, from the ejection region of the print unit 12 where the opening section 22A of the groove 22 is facing vertically upward, in such a manner that the opening section 22A of the groove 22 is facing in a horizontal direction.

As described above, in the inkjet recording apparatus 10 according to the present embodiment, the following steps are carried out sequentially while the intermediate transfer drum 14 rotates in a prescribed direction: formation of an image onto the intermediate transfer drum 14, transfer of the image onto the recording medium 16, removal of adhering material from the outer circumferential surface of the intermediate transfer drum 14 by means of the first cleaning blade 20, removal of adhering material from the first cleaning blade by means of the second cleaning blade, removal of adhering material from the second cleaning blade by means of preliminary ejection, and recovery of the ink collected in the groove 22.

Description of Structure of Recording Head

Next, the structure of the recording heads 12K, 12C, 12M and 12Y is described below in detail. The recording heads 12K, 12C, 12M and 12Y of the ink colors have the same structure, and a reference numeral 50 is hereinafter designated to any of the heads.

Figure 3A:
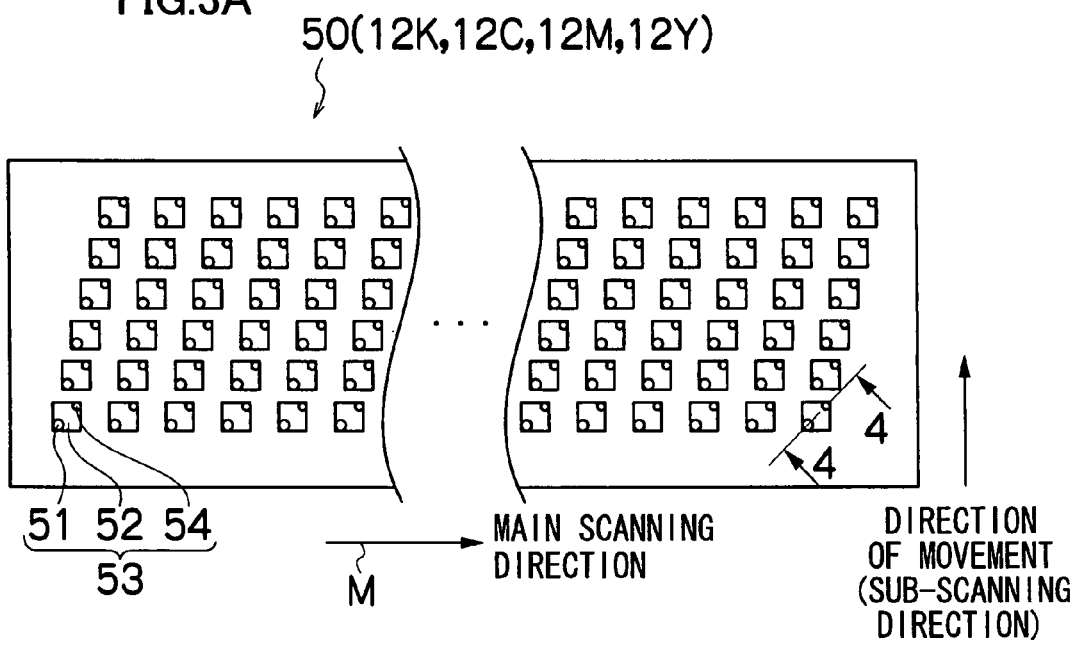
FIGS. 3A to 3C are plan view perspective diagrams showing an example of the composition of a print head.
Figure 3B:
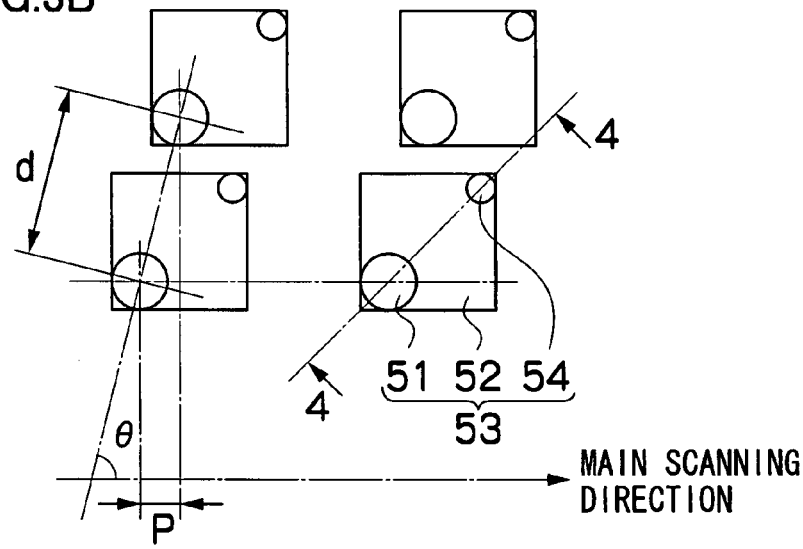

FIG. 3A is a plan view perspective diagram showing an example of the structure of a head 50; and FIG. 3B is another plan view perspective diagram showing the example of the structure of the head 50. Furthermore, FIG. 3C is a plan view perspective diagram showing a further example of the structure of the head 50.

Figure 3C:
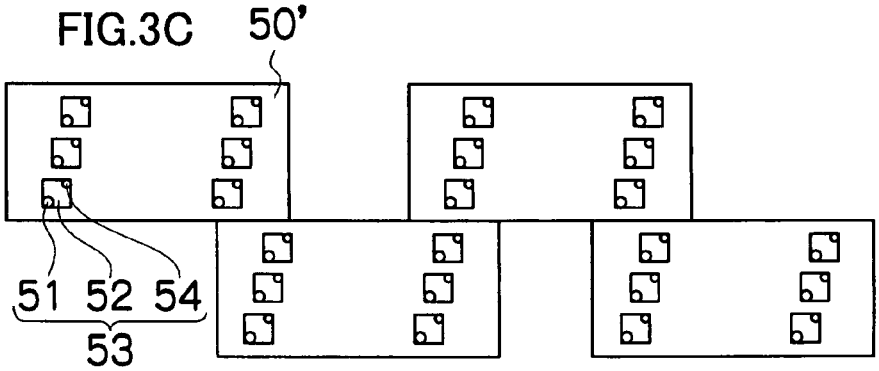

As shown in FIGS. 3A to 3C, the head 50 according to the present embodiment has a structure in which a plurality of ink chamber units 53, comprising nozzles 51 from which ink droplets are ejected and pressure chambers 52 connecting to the respective nozzles 51 are disposed in the form of a staggered matrix, and the effective nozzle pitch is thereby made small.

More specifically, as shown in FIGS. 3A and 3B, the head 50 according to the present embodiment is a full-line head having one or more nozzle rows in which a plurality of nozzles 51 for ejecting ink droplets are arranged through a length corresponding to the width of the image forming region of the intermediate transfer drum 14, in the main scanning direction (the lengthwise direction of the head 50, which is substantially perpendicular to the direction of movement).

Moreover, as shown in FIG. 3C, it is also possible to achieve a length corresponding to the full width of the image forming region of the intermediate transfer drum 14 by combining together in a staggered configuration a plurality of short heads 50' having nozzles 51 arranged to a short length in a two-dimensional fashion, and although not shown in the drawings, it is also possible to combine short heads together in a linear arrangement.

As shown in FIGS. 3A to 3C, the pressure chamber 52 provided corresponding to each of the nozzles 51 is approximately square-shaped in plan view, and a nozzle 51 and a supply port 54 are provided respectively at either corner of a diagonal of the pressure chamber 52. Moreover, the pressure chambers 52 are each connected via a supply port 54 to a common liquid chamber (not shown in FIGS. 3A to 3C; and indicated by reference numeral 55 in FIG. 4).

Figure 4:
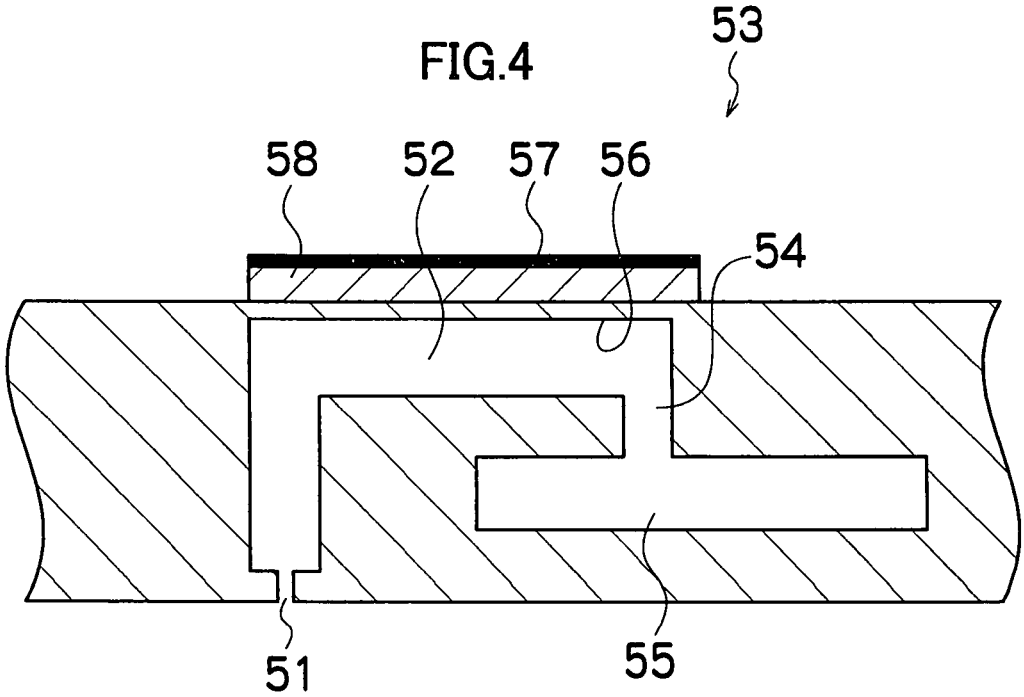
FIG. 4 is a cross-sectional diagram showing the three-dimensional structure of a head.

As shown in FIG. 4, piezoelectric elements 58 each provided with an individual electrode 57 are bonded to a diaphragm 56 which forms the upper face of the pressure chambers 52 and also serves as a common electrode, and each piezoelectric element 58 is deformed when a drive voltage is applied between the individual electrode 57 and the common electrode (diaphragm 56), thereby causing ink to be ejected from the nozzle 51. When ink is ejected, new ink is supplied to each pressure chamber 52 from the common flow channel 55, via the supply port 54.

As shown in FIG. 3B, the plurality of nozzle 51 having this structure are composed in a matrix arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting a structure in which a plurality of nozzle 51 are arranged at a uniform pitch d in a direction having an angle θ with respect to the main scanning direction, the pitch P of the nozzles projected so as to align in the main scanning direction is $d \times \cos\theta$.

More specifically, the arrangement can be treated equivalently to one in which the nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles/inch). Below, in order to facilitate the description, it is supposed that the nozzles 51 are arranged in a linear fashion at a uniform pitch (P), in the longitudinal direction of the head 50 (main scanning direction).

In a full-line head comprising rows of nozzles corresponding to the entire width of the image forming region of the intermediate transfer drum 14, "main scanning" is defined as printing a line formed of a row of dots, or a line formed of a plurality of rows of dots in the breadthways direction of the image forming region of the intermediate transfer drum 14 (the direction perpendicular to the movement direction of the image forming region of the intermediate transfer drum 14) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIGS. 3A to 3C are driven, it is desirable that main scanning is performed in accordance with (3) described above. On the other hand, "sub-scanning" is defined as to repeatedly perform printing of one line (a line formed of a row of dots, or a line formed of a plurality of rows of dots) formed by the main scanning action, by moving the image forming region of the intermediate transfer drum 14 described above with respect to the print unit 12.

In other words, the "main scanning" is the action of driving the nozzles so as to print a line constituted by one row of dots, or a plurality of rows of dots, in the breadthways direction of the image forming region of the intermediate transfer drum 14, and the "sub-scanning" is the action of repeating the printing of a line constituted by one row of dots or a plurality of rows of dots formed by the main scanning.

In implementing the present invention, the arrangement of the nozzles is not limited to that of the example illustrated. Moreover, a method is employed in the present embodiment where an ink is ejected by means of the deformation of the actuator, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Furthermore, the present embodiment is described above with reference to a line head which comprises at least one or more nozzle row of a length corresponding to the full width of the image forming region of the intermediate transfer drum 14, but it is also possible to adopt a serial type of head which performs image recording in the breadthways direction of the image forming region of the intermediate transfer drum 14 while scanning in the breadthways direction of the image forming region of the intermediate transfer drum 14 and moving the recording medium in a direction perpendicular to the breadthways direction of the image forming region of the intermediate transfer drum 14, thereby performing image recording over the whole face of the recording medium.

Description of Supply System

Figure 5:
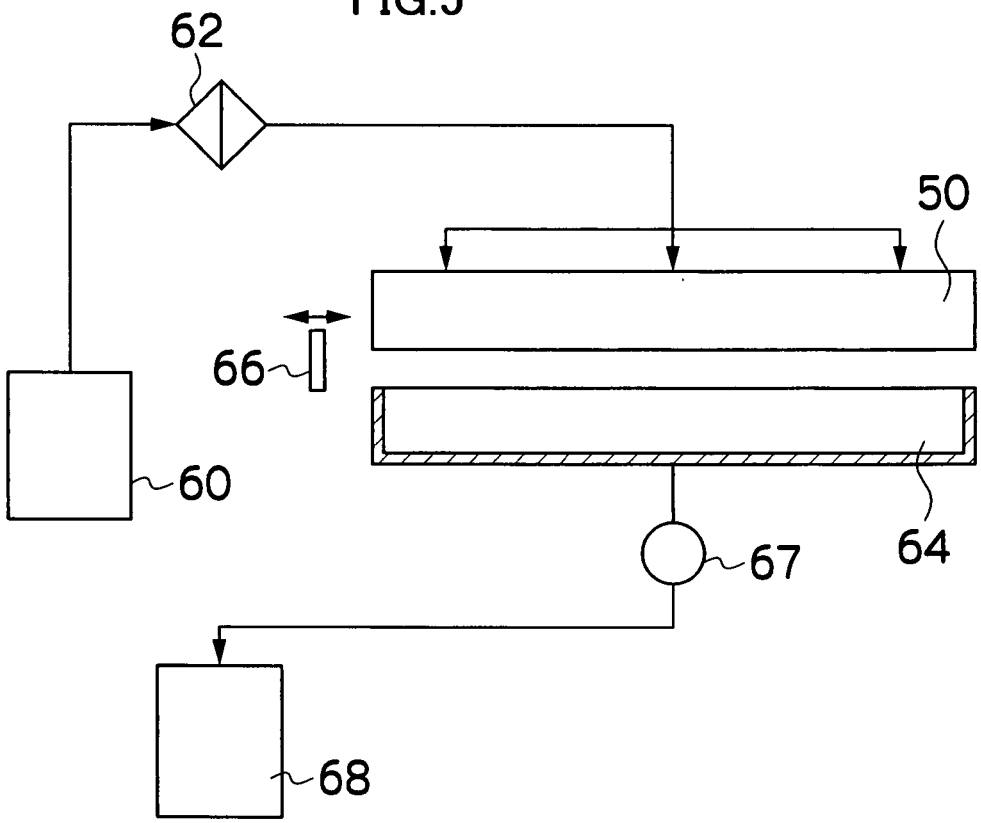
FIG. 5 is a principal block diagram showing the composition of an ink supply system of the inkjet recording apparatus shown in FIG. 1.

Next, the general composition of the supply system of the inkjet recording apparatus 10 is described below. FIG. 5 is a conceptual diagram showing the composition of an ink supply system in the inkjet recording apparatus 10.

The ink supply tank 60 is a base tank to supply ink. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the head 50 as described above. The filter mesh size of the filter 62 is preferably equivalent to or less than the diameter of each nozzle and commonly about 20 μm.

It is preferable to provide a sub-tank (not shown in drawings) integrally to the print head 50 or near the head 50. The sub-tank has a damper function for preventing variation in the internal pressure of the pressure chamber 52 and the common flow channel 55 and a function for improving refilling of the print head.

Possible modes for controlling the internal pressure of the common flow channel 55 by means of the sub-tank include: a mode where the internal pressure of the pressure chamber 52 is controlled by the differential in the liquid head pressure between a sub tank which is open to the external air and the pressure chambers 52 inside the head 50; and a mode where the internal pressures of the sub-tank and the pressure chambers 52 are controlled by a pump connected to a sealed sub tank; and the like. Either of these modes may be adopted.

Description of Maintenance of Head

As shown in FIG. 5, a cap 64 forming a device for preventing the drying of the nozzles 51 and increase in the viscosity of the liquid in the vicinity of the nozzles 51 is provided in the inkjet recording apparatus 10, and a blade 66 is provided as a device for cleaning (wiping) the nozzle forming surface (ink ejection surface) in which the nozzles 51 are formed.

A maintenance unit including the cap 64 and the blade 66 can be relatively moved with respect to the head 50 by a movement mechanism (not shown), and is moved from a predetermined holding position to a position below the head 50 as required.

The cap 64 is displaced upward and downward in a relative fashion with respect to the print head 50 by an elevator mechanism (not shown). When the power of the inkjet recording apparatus 10 is switched off or when in a print standby state, the cap 64 is raised to a predetermined raised position thereby placing same in close contact with the head 50 (the nozzle forming surface of the head 50), in such a manner that the nozzle forming surface is covered with the cap 64 and the nozzle forming surface is protected by the cap 64.

During printing or during standby, if the use frequency of a particular nozzle 51 has declined and the ink viscosity in the vicinity of the nozzle 51 has increased, then a preliminary ejection (purging, dummy ejection, spit ejection) is performed in order to remove the degraded ink. Although the details are described hereinafter, in the inkjet recording apparatus 10 according to the present embodiment, preliminary ejection is carried out toward the groove 22 provided in the outer circumferential surface of the intermediate transfer drum 14. Of course, it is also possible to combine, as appropriate, the use of preliminary ejection carried out by abutting the cap 64 as shown in FIG. 5 against the ink ejection surface and preliminary ejection carried out by ejecting ink onto the image forming region of the intermediate transfer drum 14.

Although the details are described hereinafter, when carrying out preliminary ejection for ejecting ink into the groove 22, the position of the groove 22 provided in the outer circumferential surface of the intermediate transfer drum 14 is determined, and the intermediate transfer drum 14 is rotated in such a manner that the groove 22 is moved to the ejection region directly below the print unit 12. Furthermore, the amount of ink in the groove 22 is determined and if the amount of ink in the groove 22 exceeds a previously established threshold value, then preliminary ejection is carried out after expelling the ink in the groove 22 to an output tray.

Also, when bubbles have become intermixed in the ink inside the head 50, the cap 64 is placed on the head 50, ink (ink in which bubbles have become intermixed) is removed by suction via the nozzles 51 with a suction pump 67, and the ink removed by suction is sent to a recovery tank 68. This suction operation is also carried out in order to remove degraded ink having increased viscosity (hardened ink), when liquid is loaded into the ejection head for the first time or when the head starts to be used after having been out of use for a long period of time.

The blade 66 functions as a wiping device for removing dirt from the nozzle forming surface by moving while pressing against the nozzle forming surface, and an elastic member, or the like, is suitable for use in the blade 66. In other words, the blade 66 has a prescribed strength (rigidity) and a prescribed elasticity, and the surface thereof has prescribed hydrophobic properties which repulse the various types of liquid that are ejected from the ejection head. The blade 66 is constituted by a member which is capable of wiping off and removing liquid (liquid that has solidified on the nozzle forming surface) and other foreign matters which have adhered to the nozzle forming surface.

Furthermore, although not shown in FIG. 5, the head maintenance mechanism (head maintenance device) of the inkjet recording apparatus 10 comprises: a blade elevator mechanism (not shown) which moves the blade 66 in the upward and downward directions and thus switches the blade 66 between states of contact and non-contact with the nozzle forming surface; and a cleaning member which removes the foreign matter adhering to the blade 66.

Description of Control System

Figure 6:
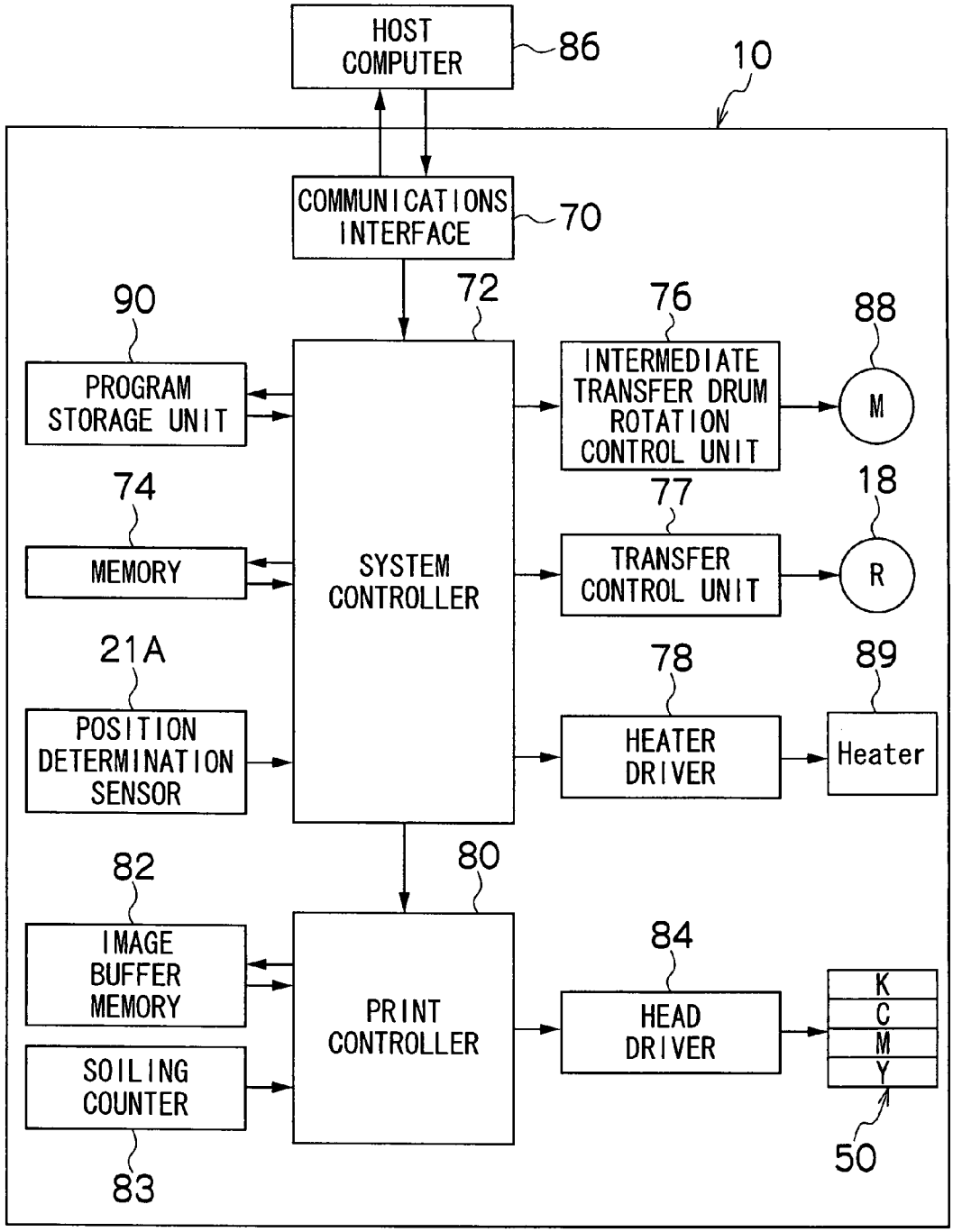
FIG. 6 is a principal block diagram showing the system configuration of the inkjet recording apparatus shown in FIG. 1.

Next, the control system of the inkjet recording apparatus 10 according to the present example is described below. FIG. 6 is a principal block diagram showing the system composition of the inkjet recording apparatus 10.

The inkjet recording apparatus 10 comprises a communications interface 70, a system controller 72, a memory 74, an intermediate transfer drum rotation control unit 76, a transfer control unit 77, a heater driver 78, a print controller 80, an image buffer memory 82, a soiling counter 83, a head driver 84, and the like.

The communications interface 70 is an interface unit which functions as an image input device for receiving image data transmitted by a host computer 86. A serial interface such as USB (Universal Serial Bus), IEEE 1394, Ethernet (registered trademark), wireless network, or a parallel interface such as a Centronics interface may be used as the communications interface 70. A buffer memory (not shown) may be mounted in this portion in order to increase the communication speed.

The image data sent from the host computer 86 is received by the inkjet recording apparatus 10 through the communications interface 70, and is temporarily stored in the memory 74. The memory 74 is a storage device for storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with prescribed programs, as well as a calculation device for performing various calculations. More specifically, the system controller 72 controls the various sections, such as the communications interface 70, memory 74, intermediate transfer drum rotation control unit 76, transfer control unit 77, heater driver 78, and the like, as well as controlling communications with the host computer 86 and writing and reading to and from a memory element such as the memory 74, and it also generates control signals for controlling the motor 88 of the conveyance system and the heater 89.

A desirable mode is one in which a ROM is provided for storing programs to be executed by the CPU of the system controller 72 and various types of data required for control procedures, and the like. The ROM may be a non-rewriteable storage device, or it may be a rewriteable storage device, such as an EEPROM.

The memory 74 is used as a temporary storage region for the image data, and it is also used as a program development region and a calculation work region for the CPU. Furthermore, the system controller 72 generates control signals for controlling the rotational mechanism of the intermediate transfer drum 14 shown in FIG. 1, the pressurization control mechanism of the transfer roller 18, the movement mechanism of the recording medium 16, and the like.

The intermediate transfer drum rotation control unit 76 includes a driver (drive circuit) which drives the motor 88 forming the drive source of the rotational mechanism of the intermediate transfer drum 14, in accordance with instructions from the system controller 72. In other words, the position of the intermediate transfer drum 14 is judged on the basis of the determination signal from the position determination device 21, and various processes such as printing and purging are carried out in accordance with the position of the intermediate transfer drum 14.

For example, when carrying out printing, the position of the image forming region of the intermediate transfer drum 14 is judged by the system controller 72 on the basis of the determination signal obtained from the position determination device 21, and the rotation of the intermediate transfer drum 14 is controlled in such a manner that the image forming region moves to the ejection region directly below the print unit 12. Furthermore, if preliminary ejection is to be carried out onto the groove 22 or the image forming region of the intermediate transfer drum 14, then on the basis of a determination signal obtained from the position determination device 21, the system controller 72 judges the position of the groove 22 or the image forming region, and the rotation of the intermediate transfer drum 14 is controlled in accordance with the control signal sent from the system controller 72 in such a manner that the groove 22 or the image forming region moves to the ejection region directly below the print unit 12.

The transfer control unit 77 implements control for supplying recording medium 16 between the intermediate transfer drum 14 and the transfer roller 18 in accordance with the movement of the image forming region of the intermediate transfer drum 14, and it also controls the timing at which the recording medium 16 is pressed against the intermediate transfer drum 14, and the pressure that is applied in this case. In other words, if it is judged by the system controller 72 that the image forming region of the intermediate transfer drum 14 has arrived at the transfer region where the transfer roller 18 is positioned, then on the basis of a control signal sent by the system controller 72, the supply mechanism for the recording medium 16 is operated and a recording medium 16 is supplied to the transfer region.

Furthermore, when the system controller 72 judges that the front edge portion of the recording medium 16 has arrived at the transfer roller 18, then the pressure variation mechanism of the transfer roller 18 (the mechanism which moves the transfer roller 18 in the upward or downward direction in FIG. 1) is operated, the recording medium 16 is pressed against the intermediate transfer drum 14 with a prescribed pressure, and the image formed on the image forming region of the intermediate transfer drum 14 is transferred to the recording medium 16.

The heater driver 78 is a block which controls the heater 89 in accordance with instructions from the system controller 72, and this heater 89 includes a heater for adjusting the temperature of the print unit 12, a heater for provisionally fixing the image formed on the image forming region of the intermediate transfer drum 14, a heater for fixing the image by heating the recording medium 16 after the image has been transferred, and the like.

The print controller 80 includes a drive waveform generation unit which generates drive signal waveforms in order to drive the piezoelectric elements 58 (see FIG. 4) corresponding to the respective nozzles 51 of the recording head 50. The drive signal waveforms generated by the drive waveform generation unit are supplied to the head driver 84. The signals output from the drive waveform generation unit may be digital waveform data, or they may be analog voltage signals.

The print controller 80 is provided with an image buffer memory 82, and image data, parameters, and other data are temporarily stored in the image buffer memory 82 when image data is processed in the print controller 80. FIG. 6 shows a mode in which the image buffer memory 82 is attached to the print controller 80; however, the memory 74 may also serve as the image buffer memory 82. Also possible is a mode in which the print controller 80 and the system controller 72 are integrated to form a single processor.

To give a general description of the sequence of processing from image input to print output, image data to be printed (original image data) is input from an external source via the communications interface 70, and is accumulated in the memory 74. At this stage, multiple-value RGB image data is stored in the memory 74, for example.

In this inkjet recording apparatus 10, an image which appears to have continuous tonal graduations to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the memory 74 is sent to the print controller 80 through the system controller 72, and is converted into a dot pattern.

In other words, the print controller 80 performs processing for converting the input RGB image data into dot data for the four colors of K, C, M and Y. The dot data generated by the print controller 80 in this way is stored in the image buffer memory 82. This dot data of the colors is converted into KCMY droplet ejection data for ejecting ink from the nozzles of the head 50, thereby establishing the ink ejection data to be printed.

The head driver 84 outputs drive signals for driving the actuators 58 corresponding to the nozzles 51 of the head 50 in accordance with the print contents, on the basis of the ink ejection data and the drive signal waveforms supplied by the print controller 80 (the drive waveform generation unit). A feedback control system for maintaining constant drive conditions in the recording heads may be included in the head driver 84.

By supplying the drive signals output by the head driver 84 to the head 50 in this way, ink is ejected from the corresponding nozzles 51. By controlling ink ejection from the heads 50 in synchronization with the movement speed of the intermediate transfer drum 14, an image is formed on the intermediate transfer drum 14.

As described above, the ejection volume and the ejection timing of the ink droplets from the nozzles are controlled via the head driver 84, on the basis of the ink ejection data generated by implementing the required signal processing in the print controller 80, and the drive signal waveform. By this means, desired dot sizes and dot positions can be achieved.

If the preliminary ejection is carried out, then a drive signal corresponding to an ink ejection amount equivalent to the volume of each pressure chamber is applied to each of the piezoelectric elements 58, in order that ink of increased viscosity inside each of the nozzles 51 and air bubbles inside each of the pressure chambers 52 can be expelled reliably. The amount of ink ejected into the groove 22 by the preliminary ejection operation is counted up by a counter (not shown), as preliminary ejection amount information, and this preliminary ejection amount information is read out as and when appropriate by the system controller 72.

The soiling counter 83 shown in FIG. 6 is a counter which counts up the amount of ink remaining on the intermediate transfer drum 14 rather than being transferred from the intermediate transfer drum 14 to the recording medium 16. The count value of the soiling counter 83 is incremented when ink is deposited onto the intermediate transfer drum 14 from the print unit 12. The amount of ink remaining on the intermediate transfer drum 14 is determined by subtracting the amount of ink transferred to the recording medium 16 from the amount of ink deposited by the print unit (i.e., "the amount of ink deposited by the print unit"—"the amount of ink transferred to the recording medium 16"). The amount of ink deposited by the print unit is calculated from the image data (dot data), and the amount of ink transferred to the recording medium 16 is determined from the size of the recording medium 16 and the printed surface area. The printed surface area is determined from the results of reading in the print region of the recording medium by means of a reading apparatus, such as a scanner (not illustrated).

The program storage unit 90 stores control programs for the inkjet recording apparatus 10, and the system controller 72 reads out the various control programs stored in the program storage unit, as and when appropriate, and executes the control programs.

Detailed Structure of Intermediate Transfer Drum

Figure 7:
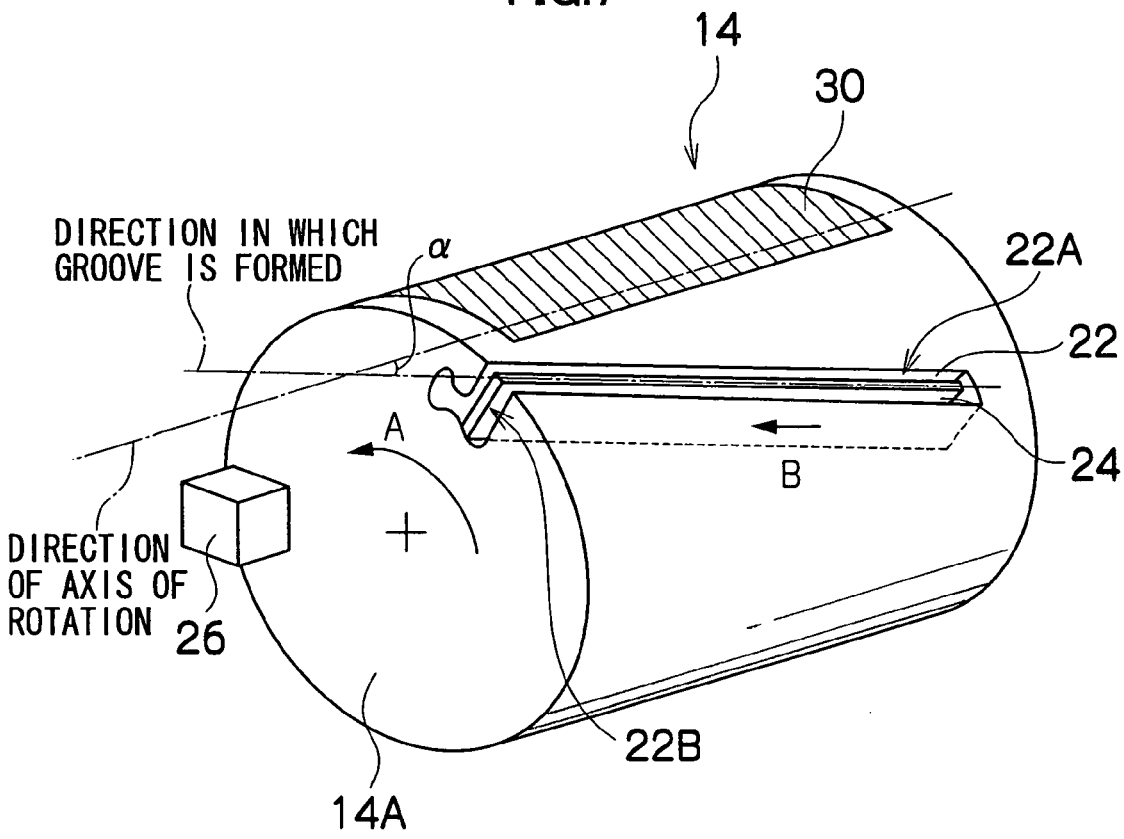
FIG. 7 is a perspective diagram showing the structure of the intermediate transfer drum shown in FIG. 1.

Next, the detailed structure of the intermediate transfer drum 14 shown in FIG. 1 is described below. FIG. 7 is an oblique diagram showing the structure of the intermediate transfer drum 14.

As shown in FIG. 7, the intermediate transfer drum 14 comprises a groove 22 which has an opening section 22A in the outer circumferential surface of the intermediate transfer drum 14 and an opening section 22B on the side face of the intermediate transfer drum 14, the groove 22 being formed so as to avoid the image forming region 30 (a portion of the image forming region is indicated by diagonal hatching in FIG. 7), in a direction that forms an angle of $\alpha$ with respect to the direction of the axis of rotation (the direction perpendicular to the direction of movement of the intermediate transfer drum 14).

The groove 22 is provided on the downstream side of the image forming region 30 on the outer circumferential surface of the intermediate transfer drum 14, and it has a length which corresponds to the width of the head 50 in the direction perpendicular to the direction of movement of the intermediate transfer drum 14 (namely, the length of the head 50 in the direction following the direction of the axis of rotation of the intermediate transfer drum 14). FIG. 7 shows an example of the groove 22 which is formed to a greater length than the width of the head 50 (in other words, than the width of the image forming region).

Furthermore, one end portion of the groove 22 reaches to one side face 14A of the intermediate transfer drum 14 (one of the end portions in the direction of the axis of rotation), and the groove 22 has an inclined structure whereby it becomes lower as it approaches the end adjacent to the opening section 22B. An opening and closing member (not shown in FIG. 7 and indicated by reference numeral 32 in FIG. 8) is provided in the opening section 22B of the groove 22 provided in one side face 14A of the intermediate transfer drum 14; this opening and closing member is opened when the groove 22 arrives at the position of the recovery tray 26 and is halted there, the ink and adhering material collected in the groove 22 flow into the recovery tray 26 via the surface of the opening and closing member, and when a prescribed time period has elapsed, the opening and closing member closes the opening section 22B, the intermediate transfer drum 14 is rotated, and the opening section 22B of the groove 22 is moved from the position at which the recovery tray 26 is disposed.

Figure 8:
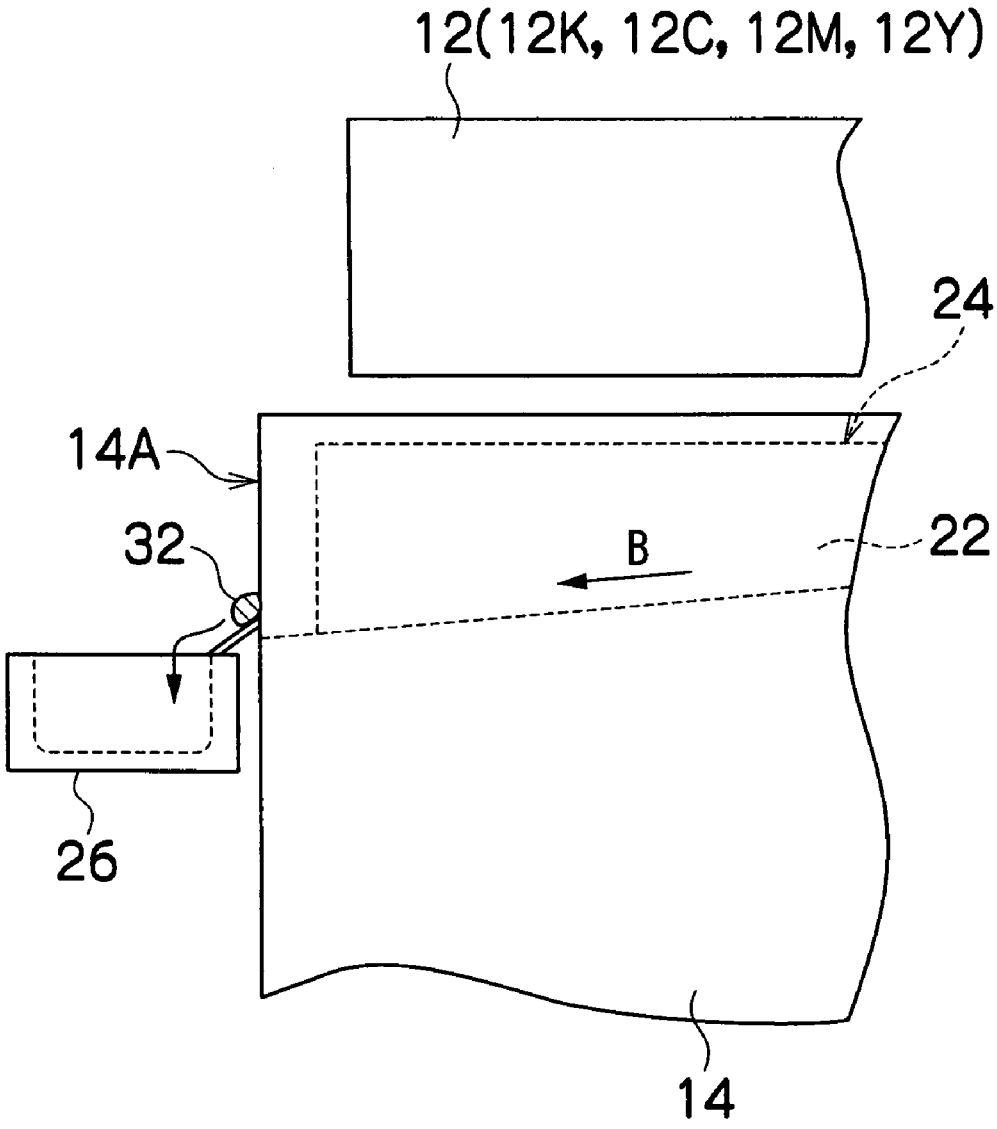
FIG. 8 is a conceptual diagram showing a state where ink is expelled from the groove into the recovery tray.

In other words, as shown in FIG. 8, when the opening section 22B of the groove 22 arrives at the position where the recovery tray 26 is disposed, the intermediate transfer drum 14 is halted, the opening and closing member 32 provided in the groove 22 in the side face 14A of the intermediate transfer drum 14 is opened in such a manner that it falls to the outer side of the intermediate transfer drum 14, and the front end portion of the opening and closing member 32 enters inside the recovery tray 26. In this way, the opening and closing member 32 functions as a member which guides ink inside the groove 22 into the recovery tray 26, the ink collected inside the groove 22 moves along the gradient of the groove 22 in the direction B indicated by the arrow in FIG. 7, and furthermore, it is guided into the recovery tray 26 via the opening and closing member 32, from the opening section 22B of the groove 22 provided in the side face 14A of the intermediate transfer drum 14.

Figure 10:
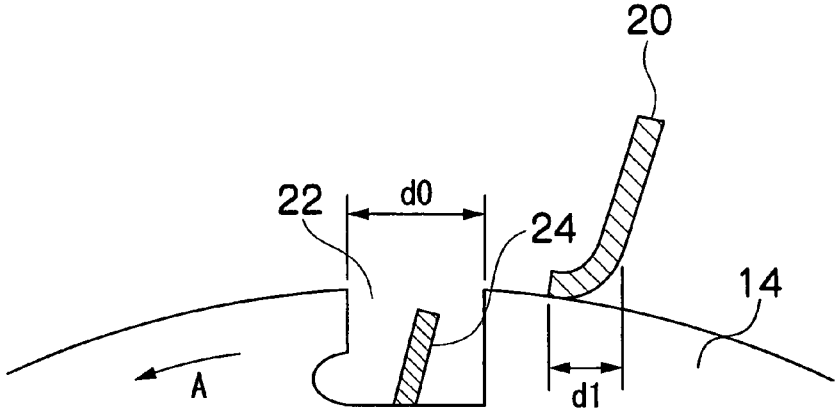
FIG. 10 is a cross-sectional diagram of FIG. 9.

FIG. 9 shows an enlarged view of the positional relationship between the first cleaning blade 20 and the second cleaning blade 24. Furthermore, FIG. 10 is a cross-sectional diagram of FIG. 9, as viewed from the side face of the intermediate transfer drum 14. As shown in FIG. 9, the groove 22 is formed along a direction that forms an angle of $\alpha$ with respect to the direction of the axis of rotation of the intermediate transfer drum 14, and the width of the groove 22 in the direction perpendicular to the direction in which the groove is formed (in other words, in the breadthways direction of the groove 22) is $d_0$.

In order to maintain a state of continually rubbing against the outer circumferential surface of the intermediate transfer drum 14, the first cleaning blade 20 is pressed against the outer circumferential surface of the intermediate transfer drum 14 so as to maintain a state of elastic deformation into an L shape or a J shape. The length in the breadthways direction of the portion of the first cleaning blade 20 which makes contact with the intermediate transfer drum 14 in this state is $d_1$. This contacting portion having a length of $d_1$ forms the portion that makes contact with the second cleaning blade 24. By composing the groove 22 and the first cleaning blade 20 in such a manner that the relationship between the width $d_0$ of the groove 22 in the breadthways direction and the length $d_1$ of the contacting portion of the first cleaning blade 20 in the breadthways direction, as illustrated in FIG. 9 and FIG. 10, satisfies $d_0>d_1$, then due to the restoring force of the first cleaning blade 20 created by elastic deformation, the contacting portion of the first cleaning blade 20 is able to enter inside the groove 22, and reliable contact (abutment) can be achieved between the first cleaning blade 20 and the second cleaning blade 24 which is disposed inside the groove 22.

FIG. 9 shows a mode where the first cleaning blade 20 is constituted by one long blade having a length corresponding to the length of the intermediate transfer drum 14 in the breadthways direction of the head 50, but it is also possible to adopt a mode in which a plurality of short blades are arranged with respect to the intermediate transfer drum 14 through the whole width of the head 50, or a mode where a short blade is scanned (moved) in the breadthways direction of the head 50.

Furthermore, FIG. 9 shows a mode where just one long blade corresponding to the length of the first cleaning blade 20 in the lengthwise direction is provided as the second cleaning blade 24, but it is also possible to adopt a mode in which a plurality of short blades are arranged through the full length of the first cleaning blade in the lengthwise direction, or a mode in which a short blade is scanned (moved) in the lengthwise direction of the first cleaning blade.

Figure 11:
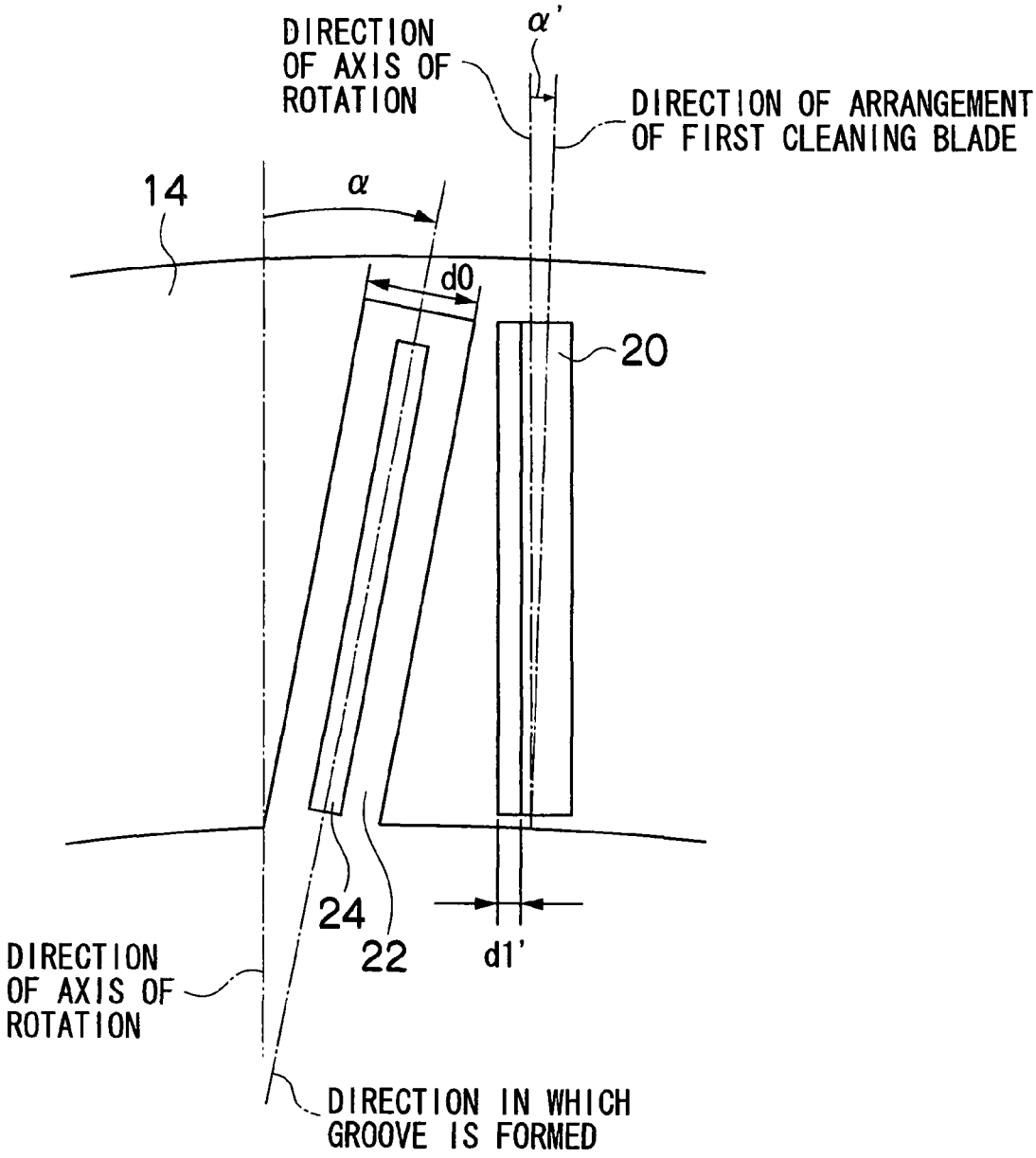
FIG. 11 is a plan diagram of FIG. 9.

Furthermore, as shown in FIG. 11, a desirable mode is one in which the first cleaning blade 20 and the second cleaning blade 24 are provided in a mutually oblique-fashion, rather than in parallel fashion. In other words, it is also possible to provide the first cleaning blade 20 in such a manner that the lengthwise direction thereof is inclined through an angle of $\alpha'$(where $\alpha'\neq\alpha$) with respect to the direction of the axis of rotation of the intermediate transfer drum 14. In the mode shown in FIG. 11, the first cleaning blade 20 and the second cleaning blade 24 are composed in such a manner that the relationship between the width $d_0$ of the groove 22 in the breadthways direction and the length $d_1'$ of the contacting portion of the first cleaning blade 20 in the breadthways direction satisfies $d_0>d_1'$.

As shown in FIG. 11, by arranging the first cleaning blade 20 and the second cleaning blade 24 in a mutually oblique fashion, the second cleaning blade 24 progressively makes contact with the first cleaning blade 20, from one end towards the other end thereof, and therefore it is possible to ensure that the second cleaning blade 24 makes contact reliably with the whole length of the first cleaning blade 20 in the lengthwise direction. Furthermore, since the first cleaning blade 20 deforms partially, then the repulsive force when the blade is restored from its deformed state is small and the drive load on the intermediate transfer drum 14 can be made small, thus helping to reduce costs by enabling miniaturization of the motor which drives the intermediate transfer drum 14.

Here, the following examples can be given for the numerical values (ranges) of the factors shown in FIG. 9 to FIG. 11, namely, the angle $\alpha$ formed between the direction of the axis of rotation of the intermediate transfer drum 14 and the direction in which the groove 22 is formed, the angle $\alpha'$ formed between the axis of rotation of the intermediate transfer drum 14 and the lengthwise direction of the first cleaning blade 20, the length $d_0$ of the groove 22 in the breadthways direction, the length $d_1$ in the breadthways direction of the portion of the first cleaning blade 20 which makes contact with the outer circumferential surface of the intermediate transfer drum 14 as shown in FIG. 9, and the length $d_1'$ in the breadthways direction of the portion of the first cleaning blade 20 which makes contact with the outer circumferential surface of the intermediate transfer drum 14 in a case where the first cleaning blade 20 is disposed in an oblique fashion with respect to the axis of rotation of the intermediate transfer drum 14 as shown in FIG. 11: $0.50<\alpha<20°$, $0.50<\alpha'<20°$(where $\alpha'\neq\alpha$), 5 mm$<d_0<$15.0 mm, 0.5 mm$<d_1<$5.0 mm, 0.5mm$<d_1'<$5.0 mm (where $d_0>d_1'$).

Figure 12:
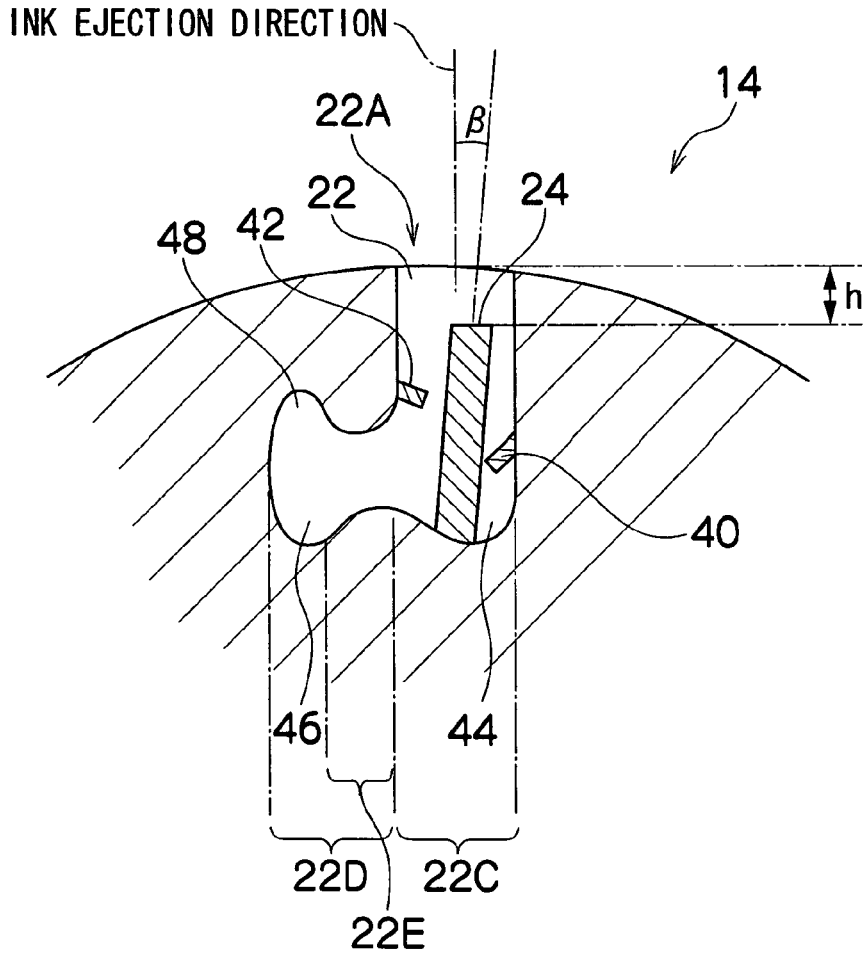
FIG. 12 is a cross-sectional diagram showing the detailed structure of the second cleaning blade shown in FIG. 1.

FIG. 12 is a cross-sectional diagram showing the detailed structure of the interior of the groove 22 (an enlarged diagram of the portion enclosed by the dotted lines in FIG. 1). As shown in FIG. 12, a second cleaning blade 24 is provided in the direction in which the groove 22 is formed, inside the groove 22, and furthermore, restrictor plates 40 and 42 for preventing the ink collected inside the groove 22 from flowing out from the opening section 22A, and recess sections 44, 46 and 48 for holding the ink, and the like, inside the groove 22, are also provided.

The restrictor plates 40 and 42 are each of a length which covers the whole length of the groove 22 in the direction in which the groove is formed 22, and they are provided in an inclined fashion with respect to the inner face of the groove 22. The ink which has flowed into the groove 22 from the opening section 22A passes over the upper surface of the restrictor plates 40 and 42 in FIG. 12, and flows inside the groove 22 via the space between the second cleaning blade 24 and each of restrictor plates 40 and 42. On the other hand, even if the ink inside the groove 22 seeks to flow out from the groove 22 along the internal faces of the groove 22, this flow of ink is cut off by colliding with the lower surfaces of the restrictor plates 40 and 42 in FIG. 12, and therefore it is possible to prevent the ink inside the groove 22 from flowing out via the opening section 22A.

Figure 13:
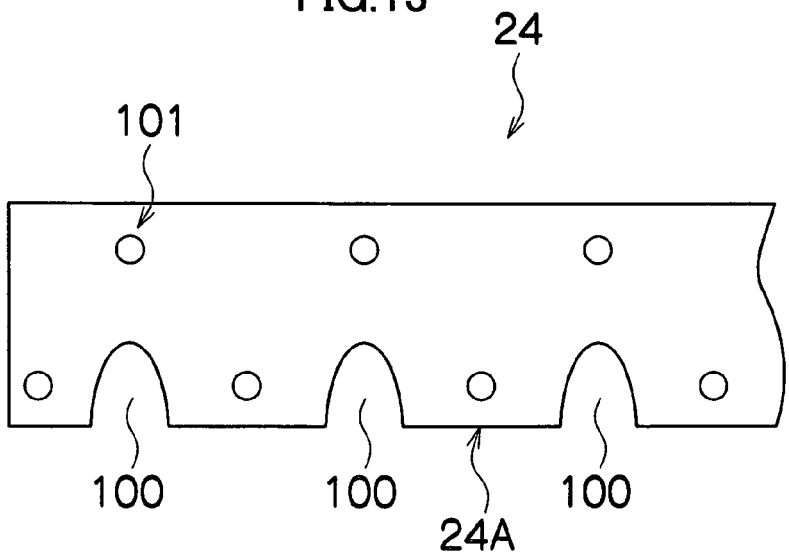
FIG. 13 is a plan diagram showing the detailed structure of the second cleaning blade shown in FIG. 1.

FIG. 13 shows the planar shape of the second cleaning blade 24. As shown in FIG. 13, a plurality of holes 100 and 101 are provided in the length direction of the second cleaning blade 24, in the side faces of the second cleaning blade 24 on the left and right-hand sides in FIG. 12. The holes provided in the second cleaning blade 24 may include holes having a semicircular shape provided at the end portion 24A as indicated by reference numeral 100, and may include holes having a circular shape as indicated by reference numeral 101. It is possible for the ink inside the groove 22 to move in the left/right direction of the second cleaning blade 24 in FIG. 12, via the holes 100 and holes 101 provided in the second cleaning blade 24.

The groove 22 comprises a straight portion 22C which is formed in a substantially linear fashion from the opening section 22A toward the center of rotation of the intermediate transfer drum 14, and an undercut section 22D which is formed in a substantially perpendicular direction with respect to the straight section 22C. Accordingly, the groove 22 has a substantially L-shaped cross-sectional form, as shown in FIG. 12. A recess section 44 forming an ink reservoir is provided in the bottom face of the straight section 22C of the groove 22, and the width in the vicinity of the boundary between the undercut section 22D and the straight section 22C is formed to be narrower than the maximum width of the undercut section 22D. Furthermore, the undercut section 22D is composed so as to have a broader width than the portion in the vicinity of the boundary (see the region 22E in FIG. 12). Moreover, recess sections 46 and 48 which form ink reservoirs are provided in the undercut section 22D. The recess sections 44, 46 and 48 have a length which covers the full length of the groove 22 in the direction in which the groove 22 is formed.

The second cleaning blade 24 is disposed in such a manner that the front tip portion thereof is lower by an amount h than the outer circumferential surface of the intermediate transfer drum 14, and it is also disposed so as to form an angle $\beta$ with respect to the ink ejection direction (vertical direction). By composing the front tip portion of the second cleaning blade 24 in such a manner that it does not project beyond the opening section 22A of the groove 22, it is possible to prevent the front tip portion of the second cleaning blade 24 from interfering with the ejection surface of the heads 12K, 12C, 12M and 12Y. A desirable mode is one where the clearance h provided at the opening section 22A of the groove 22 between the front tip portion of the second cleaning blade 24 and the outer circumferential surface of the intermediate transfer drum 14 is in the range of 0.1 mm to 2.0 mm.

Even in the case where the front tip portion of the second cleaning blade 24 does not project beyond the outer circumferential surface of the intermediate transfer drum 14, due to the restoring force of the first cleaning blade 20 caused by the elastic deformation thereof, the front tip portion of the first cleaning blade 20 can enter inside the groove 22 and therefore make contact with the second cleaning blade 24.

By inclining the second cleaning blade 24 to an angle of $\beta$ with respect to the ink ejection direction (the direction toward the center of rotation of the intermediate transfer drum 14 from the opening section 22A of the groove 22), towards the opposite side from the surface of the second cleaning blade 24 which makes contact with the first cleaning blade, it is possible to ensure that the ink ejected from the head 50 is deposited reliably onto the adhering material attached to the surface of the second cleaning blade 24 which makes contact with the first cleaning blade. If the angle $\beta$ is made large, then a high contact pressure with respect to the first cleaning blade cannot be achieved, and therefore it is desirable to set the angle $\beta$ to a range of $0.50°<\beta<45°$.

FIG. 12 shows a mode where the whole of the second cleaning blade 24 is inclined at an angle of $\beta$ with respect to the ink ejection direction, but it is also possible to provide the second cleaning blade 24 in parallel with the ink ejection direction, or to incline the surface of the second cleaning blade on which the ink lands, with respect to the ejection direction of the ink.

Description of Cleaning Control

Next, the control of the cleaning performed by the intermediate transfer drum, and the first and second cleaning blades in the inkjet recording apparatus 10 according to the present embodiment (hereinafter, simply referred to as cleaning control) is described below in detail.

Figure 14:
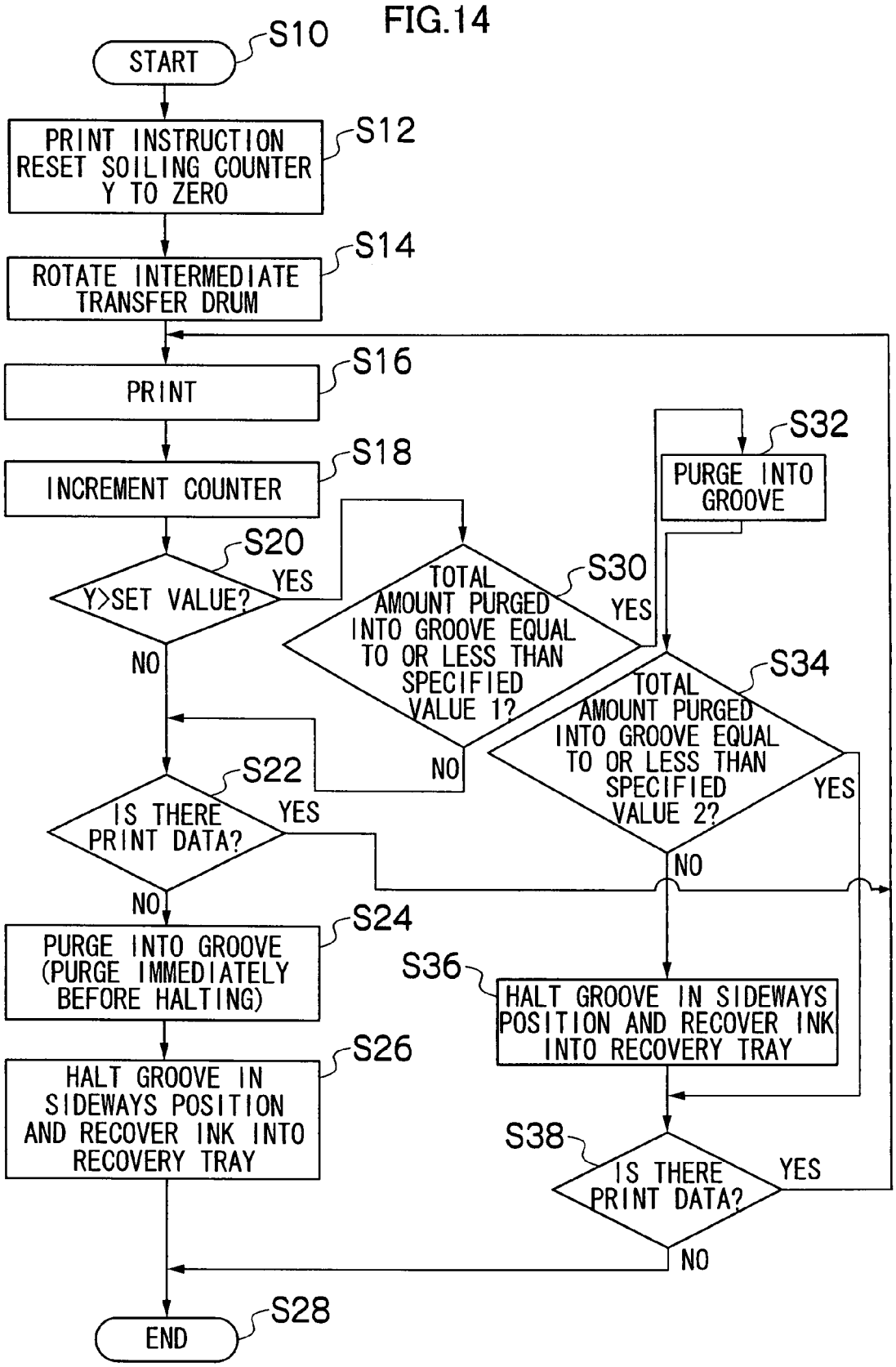
FIG. 14 is a flowchart showing a sequence of cleaning control according to an embodiment of the present invention.

FIG. 14 is a flowchart showing a sequence of cleaning control. The cleaning control shown by the flowchart in FIG. 14 functions as one portion of the overall printing control of the inkjet recording apparatus 10, and therefore a portion of the print control is included in the flowchart in FIG. 14.

When the cleaning control (print control) shown in the present example starts (step S10), in response to a print instruction to the intermediate transfer drum 14, the counter value Y of the soiling counter 83 shown in FIG. 6 is reset (step S12).

The soiling counter 83 is a counter which monitors the amount of soiling on the outer circumferential surface of the intermediate transfer drum 14, as described previously. Here, the amount of soiling means the amount of ink calculated to be remaining on the intermediate transfer drum 14 rather than being transferred to the recording medium 16. Here, the ink remaining on the intermediate transfer drum 14 does not only means the ink remaining on the image forming region, but also includes ink which has been scattered to the periphery of the image forming region, and the like. A desirable mode is one in which the amount of evaporation of the ink solvent is predicted from the operation environmental conditions (e.g., temperature, humidity, and the like), and correctional processing is carried out to multiply by a correctional coefficient which corresponds to the amount of evaporation.

Thereupon, image printing onto the recording medium 16 is carried out. In other words, firstly, the intermediate transfer drum 14, the print unit 12, and the like, are initialized, and the intermediate transfer drum 14 is rotated and halted at a default position. The position of the intermediate transfer drum 14 is determined by the position determination device shown in FIG. 1, and the position of the intermediate transfer drum 14 is judged by the system controller 72 shown in FIG. 6 on the basis of the determination results from the position determination device 21. In the initialization step, initialization processing for the head 50 (for example, preliminary ejection) is carried out, and furthermore, initialization processing for the respective units of the inkjet recording apparatus 10 (for example, counter and memory resets, and the like) is also carried out.

Thereupon, the intermediate transfer drum 14 is rotated from the default position (step S14). Subsequently, when the image forming region 30 of the intermediate transfer drum 14 arrives at the ejection region directly below the print unit 12, an image is formed on the image forming region 30 by means of ink deposited from the print unit 12. Furthermore, when the intermediate transfer drum 14 is rotated further and the groove 22 arrives at the ejection region directly below the print unit 12, it is judged whether or not preliminary ejection is to be carried out. If the head 50 satisfies conditions for carrying out preliminary ejection (for instance, if a particular nozzle has not performed ink ejection for a specified time period or greater, or if air bubbles have been determined inside the head 50), then preliminary ejection is carried out toward the groove 22.

An image is formed on the image forming region 30 by means of the ink deposited from the print unit 12, and when the image forming region 30 arrives at the transfer region where the transfer roller 18 is disposed, a recording medium 16 is supplied in synchronism with the image forming region, between the transfer roller 18 and the intermediate transfer drum 14, and the image formed on the image forming region 30 is transferred to the recording medium 16, thereby printing the desired image onto the recording medium 16 (step S16).

In other words, the printing step shown in step S16 in FIG. 14 includes a step of forming an image onto the intermediate transfer drum 14 and a step of transferring the image onto the recording medium 16 by means of the transfer roller 18.

When the step of the transferring onto the recording medium 16 has completed, the intermediate transfer drum 14 is rotated further and at the position where the first cleaning blade 20 is disposed, the adhering material including ink attached to the outer circumferential surface of the intermediate transfer drum 14 is wiped away and removed by the first cleaning blade 20.

Figure 15:
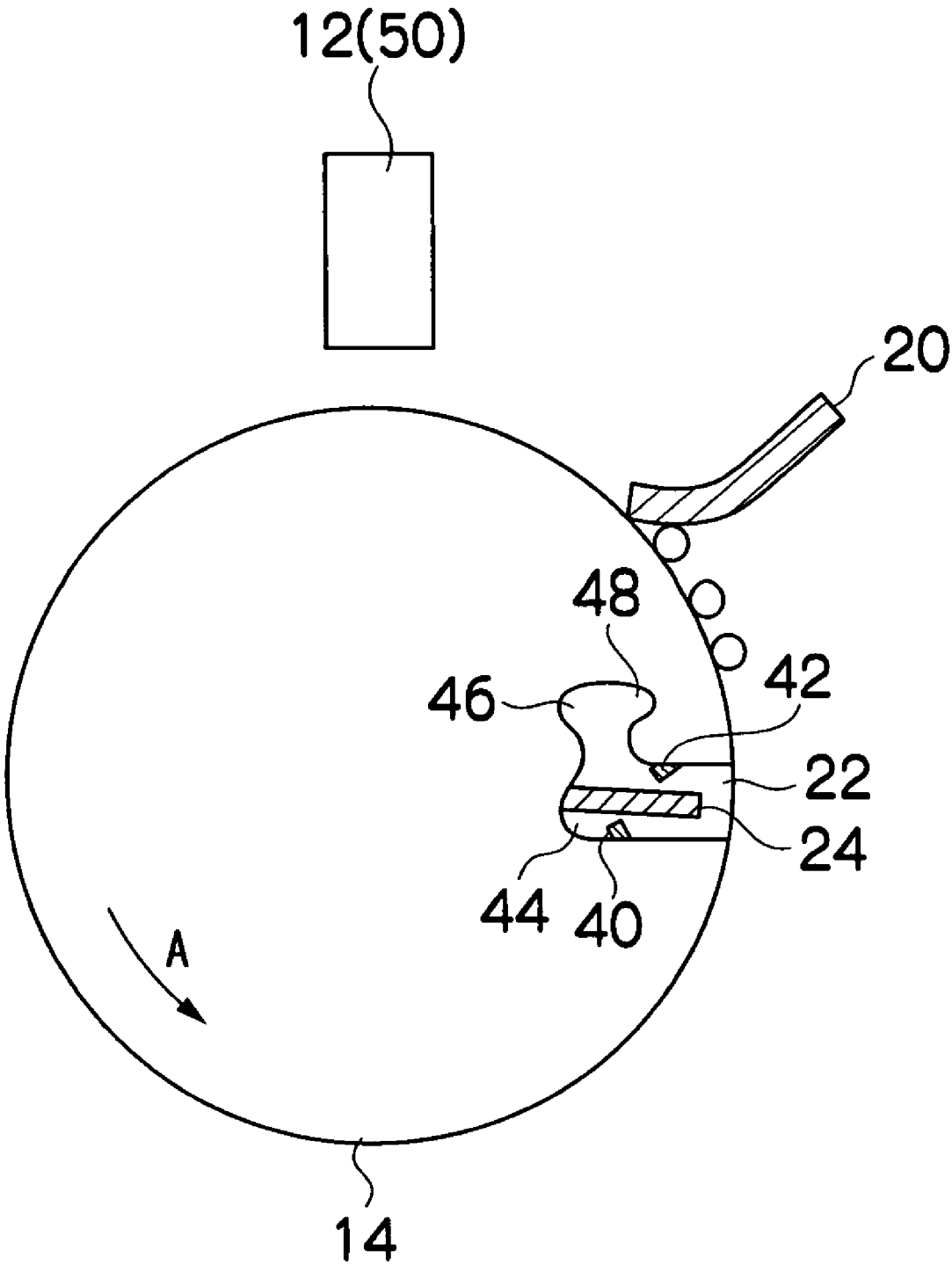
FIG. 15 is a diagram for describing a first cleaning step.

FIG. 15 shows a schematic drawing of a state of carrying out a first cleaning step for cleaning the outer circumferential surface of the intermediate transfer drum 14 by means of the first cleaning blade 20. In FIG. 15, a portion of the member shown in FIG. 1 is omitted, and only the principal part is depicted.

As shown in FIG. 15, since the first cleaning blade 20 is pressed against the outer circumferential surface of the intermediate transfer drum 14 with a prescribed pressure and thereby biased to undergo elastic deformation, the adhering material such as ink attached to the outer circumferential surface of the intermediate transfer drum 14 is removed in a reliable fashion.

Figure 16A:
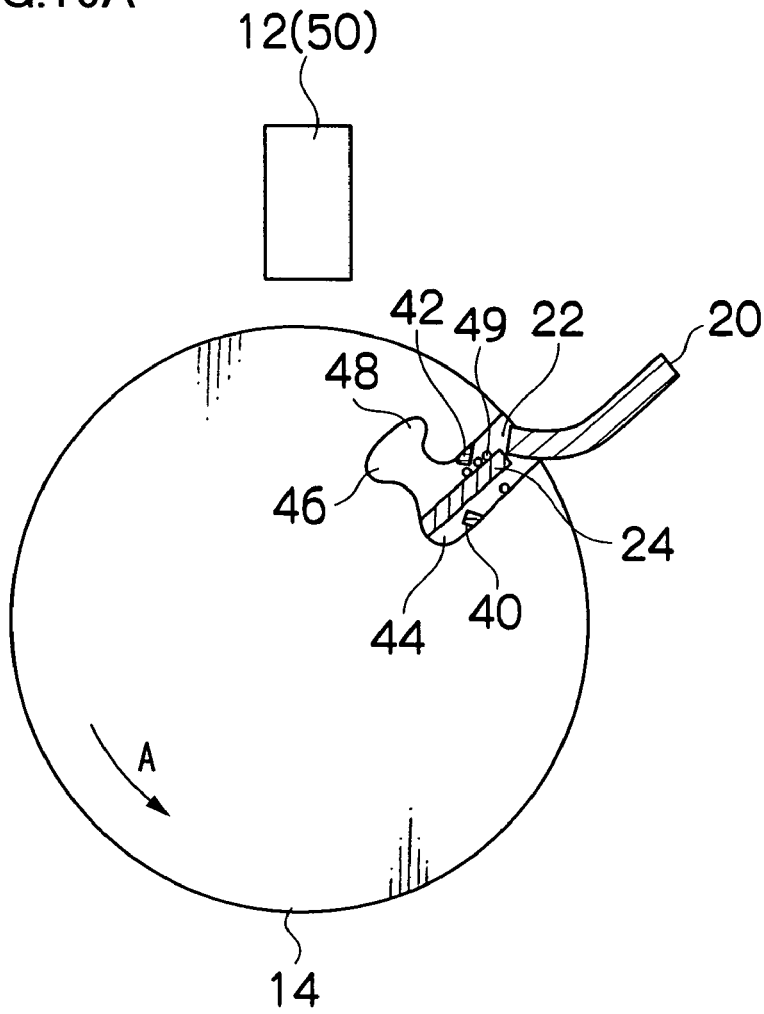
FIGS. 16A and 16B are diagrams for describing a second cleaning step.

The intermediate transfer drum 14 is rotated further and when the groove 22 in which the second cleaning blade 24 is provided arrives at the position where the first cleaning blade 20 is disposed, the adhering material attached to the first cleaning blade 20 is removed by the second cleaning blade 24. FIG. 16A is a schematic drawing showing a state of carrying out a second cleaning step of cleaning the first cleaning blade 20 by means of the second cleaning blade. Furthermore, FIG. 16B is an enlarged view of the portion of contact between the intermediate transfer drum 14 and the first cleaning blade 20 in FIG. 16A.

Figure 16B:
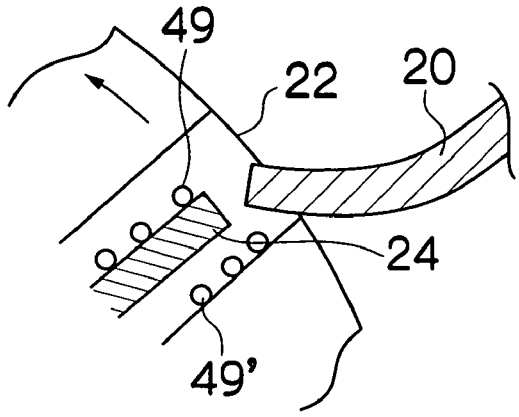

As shown in FIGS. 16A and 16B, the first cleaning blade 20 is restored from its state of elastic deformation, and the front tip portion of the first cleaning blade 20 (the portion bearing the adhering material that has been removed from the intermediate transfer drum 14) enters inside the groove 22 and makes contact with the second cleaning blade 24. When the intermediate transfer drum 14 is rotated while the first cleaning blade 20 and the second cleaning blade 24 are in a state of contact, the adhering material attached to the first cleaning blade 20 is scraped off by the second cleaning blade 24 (see reference numeral 49 in FIGS. 16A and 16B, for example).

Furthermore, the first cleaning blade 20 makes contact with the corner portion of the groove 22 on the upstream side in terms of the direction of movement of the intermediate transfer drum 14 (the right-hand corner portion in FIGS. 16A and 16B), and therefore the adhering material which is attached to the first cleaning blade 20 is also scraped off at this corner section of the groove 22. Therefore, adhering material which has been scraped off from the first cleaning blade 20 (indicated by reference numeral 49' in FIG. 16B, for example) also collects in the groove 22 on the rear side of the second cleaning blade 24 (the upstream side in terms of the direction of movement of the intermediate transfer drum 14).

Furthermore, when one printing operation onto the recording medium 16 has been completed, the amount of soiling in that one printing operation is calculated, and the value Y of the soiling counter is incremented accordingly (step S18), whereupon the procedure advances to step S20.

At step S20, it is judged whether or not the value Y of the soiling counter has exceeded a previously determined set value (step S20), and if the soiling counter value Y is equal to or less than the set value, in other words, in a state where there is very little adhering material attached to the second cleaning blade 24 (NO verdict), the procedure advances to step S22.

Figure 17:
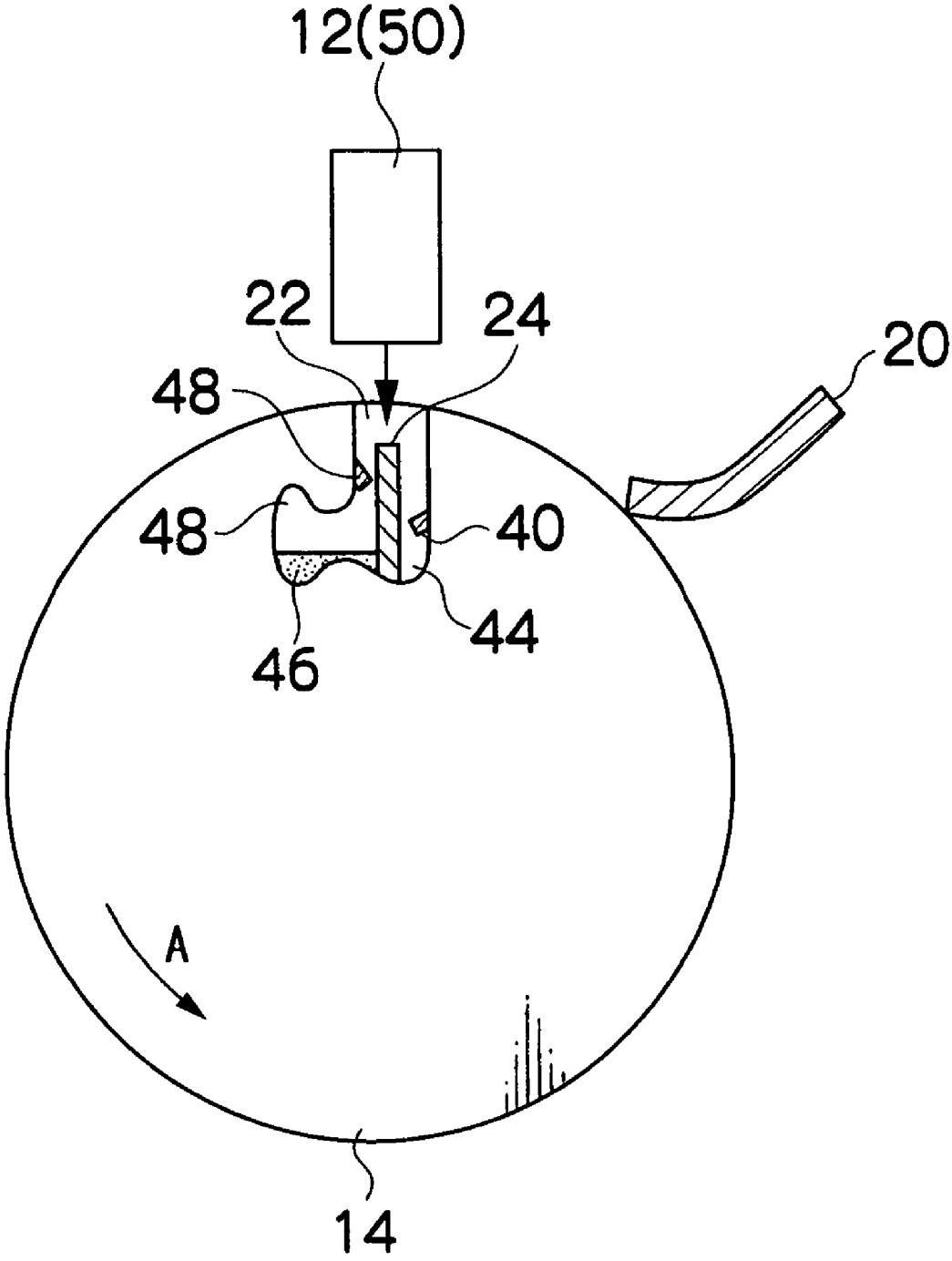
FIG. 17 is a diagram for describing a preliminary ejection step.

At step S22, it is judged whether or not there is subsequent print data, and if there is no subsequent print data (NO verdict), then the intermediate transfer drum 14 is rotated in such a manner that the groove 22 is positioned in the ejection region directly below the print unit 12. When the groove 22 arrives at the ejection region, then immediately before halting the intermediate transfer drum 14, a preliminary ejection is carried out toward the adhering material on the second cleaning blade (step S24). FIG. 17 shows a schematic drawing of a state where the preliminary ejection step has been carried out in order to perform preliminary ejection onto the second cleaning blade 24.

The ink ejected into the groove 22 in the preliminary ejection step and the adhering material including ink removed from the first cleaning blade 20 are collected in the undercut section 22D (recess section 46) of the groove 22. In FIG. 17, the ink deposited by preliminary ejection and the ink (adhering material) removed from the first cleaning blade 20 are indicated by dot hatching.

In order to expel ink which has collected in the groove 22, there must be a certain amount of ink of low viscosity (ink which has not increased in viscosity due to evaporation of the solvent component), and therefore the preliminary ejection carried out toward the second cleaning blade 24 is desirably carried out immediately before halting the intermediate transfer drum 14 (in other words, immediately before expelling the ink inside the groove 22). When performing a preliminary ejection, it is more desirable that the intermediate transfer drum 14 should be halted temporarily, since this means that the depositing positions on the second cleaning blade 24 become accurate.

Figure 18:
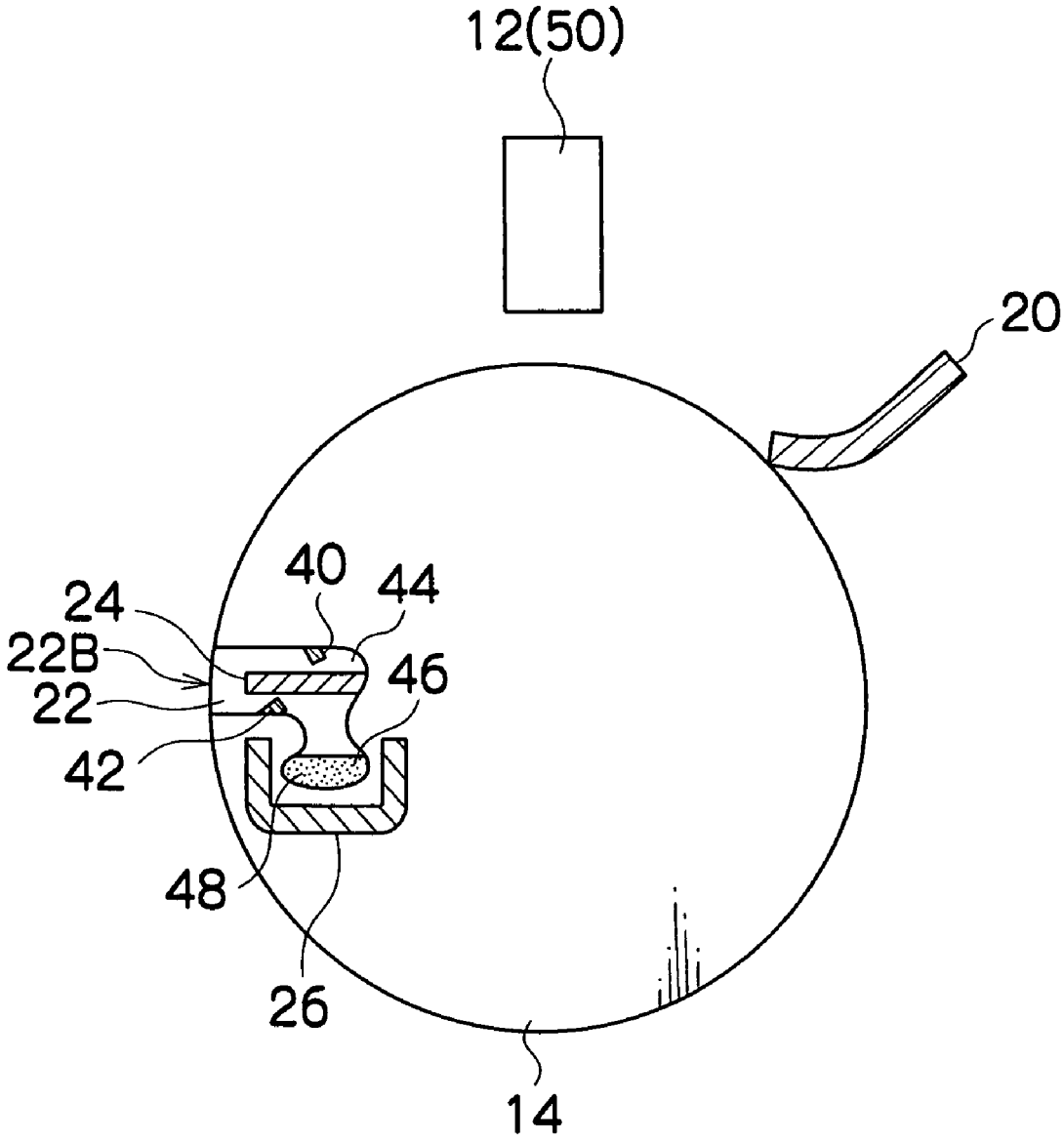
FIG. 18 is a diagram for describing a recovery step.

When the preliminary ejection step of step S24 has completed, the intermediate transfer drum 14 is rotated, the groove 22 is moved to the recovery position where the recovery tray 26 is disposed, and the intermediate transfer drum 14 then halts at the recovery position (step S26). FIG. 18 shows the intermediate transfer drum 14 after it has been halted at the recovery position, with the groove 22 facing sideways.

As shown in FIG. 18, when the intermediate transfer drum 14 is halted with the groove 22 facing sideways (in a state where the opening section 22B is facing in the horizontal direction), the ink inside the groove 22 (indicated by the dot hatching) moves to the undercut section 22D of the groove 22 (the recess section 46 and the recess sections 48). The ink situated above the second cleaning blade 24 in FIG. 18 also moves toward the lower side, via the holes 100 and 101 (see FIG. 13) provided in the second cleaning blade 24.

In this state, the opening and closing member 32 which opens and closes the opening unit 22B is opened (see FIG. 8), the ink collected inside the groove 22 is retrieved into the recovery tray 26 (step S26), and the cleaning process then terminates (step S28).

In other words, if there is no subsequent print data, then in addition to cleaning the second cleaning blade 24, the rotation of the intermediate transfer drum 14 and the opening and closing of the opening section 22B of the groove 22 by the opening and closing member 32 are controlled in such a manner that all of the ink inside the groove 22 is expelled and the cleaning control then terminates.

On the other hand, if there is subsequent print data (YES verdict) at step S22, then the procedure returns to step S16 and printing of the next image is carried out.

Furthermore, at step S20, if it is judged that the value Y of the soiling counter 83 has exceeded the set value (YES verdict), then it is further judged whether or not the total amount purged into the groove 22 is equal to or less than a specified value 1 (step S30). In other words, if the second cleaning blade 24 has become soiled by adhering material, then it is judged whether or not the second cleaning blade 24 can be cleaned by means of preliminary ejection.

At step S30, if the total purge amount exceeds the specified value 1, in other words, if the adhering material on the second cleaning blade has been removed by preliminary ejection (NO verdict), then the procedure advances to step S22.

Preliminary ejection is also carried out from the head 50 for the purpose of other objects apart from removing adhering material on the second cleaning blade 24, for example, preliminary ejection is carried out appropriately in accordance with the state of use of each of the nozzles, when image formation onto the intermediate transfer drum 14 is not being carried out, for instance. If preliminary ejection has been carried out, then the adhering material on the second cleaning blade 24 has been removed by this preliminary ejection, and therefore provided that the total amount purged by all preliminary ejection operations, regardless of their object, is equal to or greater than the specified value 1, the adhering material on the second cleaning blade 24 has been removed. Furthermore, since the volume of the groove 22 is sufficiently greater than the amount purged in one action, then it is possible to carry out a plurality of preliminary ejection actions, without having to retrieve the ink inside the groove 22.

On the other hand, at step S30, if the total purge amount is equal to or less than the specified value 1 (YES verdict), then it is judged that the second cleaning blade 24 is soiled, and the groove 22 is moved to the ejection region directly below the print unit 12, whereupon preliminary ejection is carried out toward the second cleaning blade 24 (step S32). In other words, at step S30 in FIG. 14, the soiling of the second cleaning blade 24 is judged on the basis of the total purge amount, using the reference value indicated by the specified value 1.

When preliminary ejection has been carried out at step S32, it is judged whether or not the total amount purged into the groove 22 is equal to or less than a specified value 2 (step S34). At step S34, if the total amount purged into the groove 22 exceeds the specified value 2 (YES verdict), then the intermediate transfer drum 14 is rotated, the groove 22 is halted in a sideways facing state as shown in FIG. 18, and the ink in the groove 22 is expelled to the recovery tray 26 (step S36). In other words, the specified value 2 is a reference value for the amount of ink that can be held in the groove 22, and if the total amount purged into the groove 22 exceeds this specified value 2, then control is implemented in such a manner that the ink inside the groove 22 is expelled promptly to the exterior of the groove 22. Furthermore, the relationship between the specified value 1 at step S30 and the specified value 2 at step S32 is such that "specified value 1< specified value 2".

When the ink inside the groove 22 is recovered into the recovery tray 26, it is judged whether or not there is subsequent print data (step S38), and if there is no subsequent print data (NO verdict), then the cleaning control ends, whereas if there is subsequent print data (YES verdict), then the procedure advances to step S16 and the next printing operation is carried out. Furthermore, at step S34, if the total amount purged into the groove 22 is equal to or less than the specified value 2 (YES verdict), then the procedure advances to step S38, where it is judged whether or not there is subsequent print data.

Figure 19:
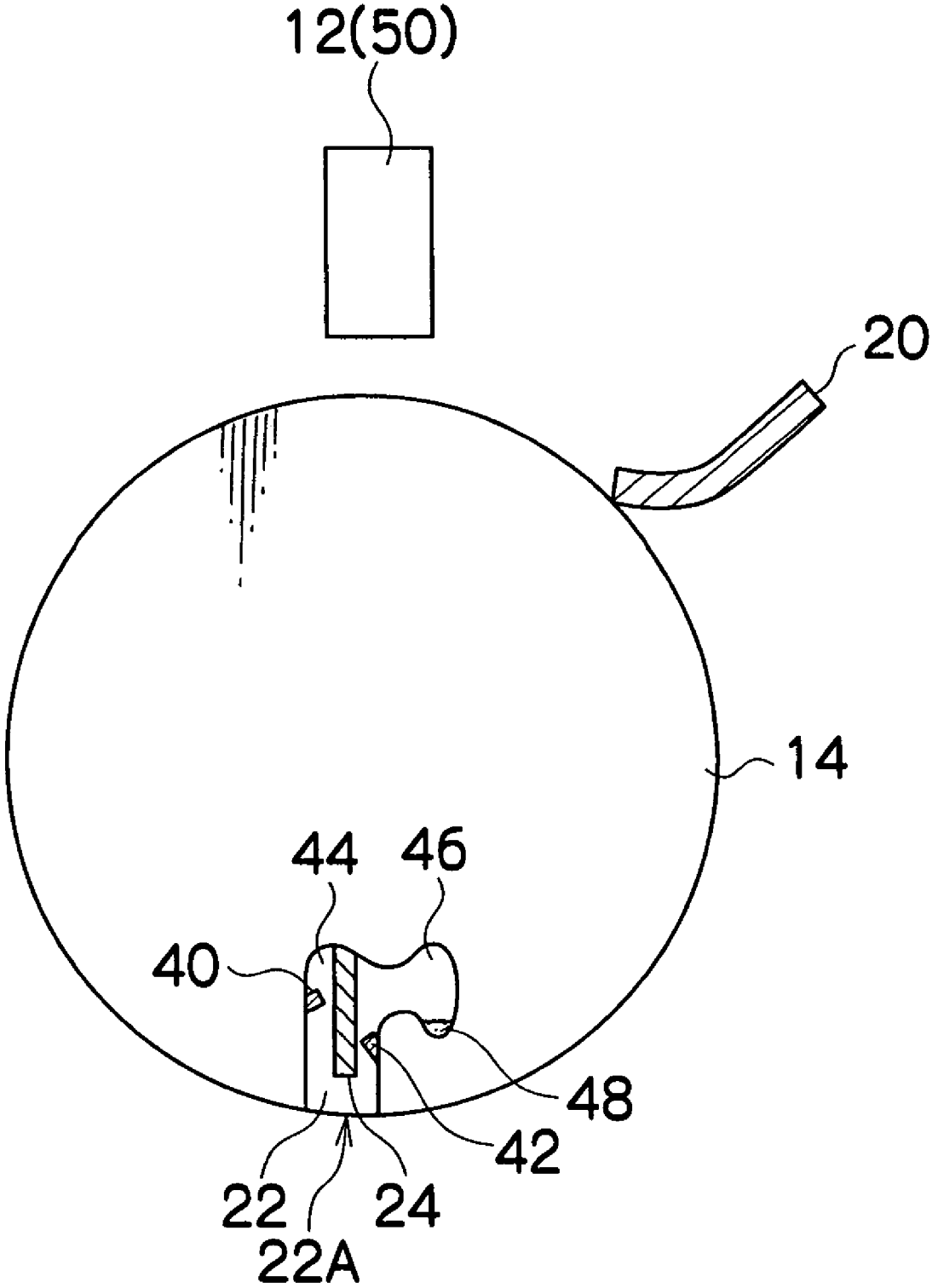
FIG. 19 is a diagram for describing a state where the opening section of the groove is facing vertically downwards.

In other words, if the amount of ink in the groove 22 has not reached the limit amount of ink which can be held, then printing of the next image is carried out without expelling the ink inside the groove 22. When the intermediate transfer drum 14 is rotated while still accommodating ink in the groove 22, and the groove 22 reaches the transfer region, as shown in FIG. 19, the opening section 22A of the groove 22, which is provided in the outer circumferential surface of the intermediate transfer drum 14, assumes a position facing vertically downwards. However, the ink present inside the groove 22 moves into the recess section 48 in the undercut section 22D and is held therein, and consequently there is no leaking of ink to the exterior from the opening section 22A of the groove 22.

The amount of ink inside the groove 22 is the sum total of the amount of ink removed from the intermediate transfer drum 14 and the amount of ink ejected into the groove 22 by preliminary ejection, but since the amount of ink ejected into the groove 22 by preliminary ejection is overwhelmingly greater than the amount of ink removed from the intermediate transfer drum 14, then in the present example, the amount of ink inside the groove 22 is judged on the basis of the amount of ink ejected into the groove 22 by preliminary ejection.

FIGS. 20A to 20D show the relationship between the rotation of the intermediate transfer drum 14 and the behavior of the ink inside the groove 22. The portions indicated by dot hatching in FIGS. 20A to 20D indicate the ink inside the groove 22.

Figure 20A:
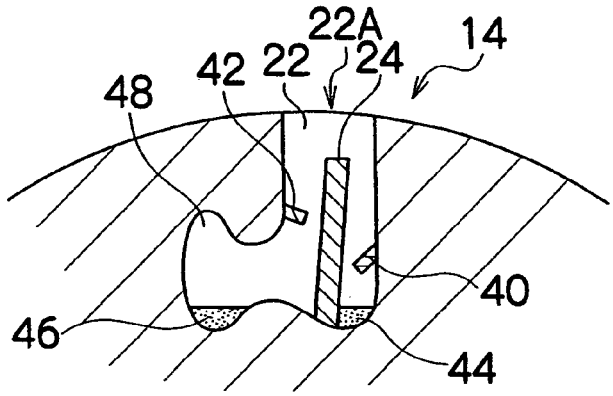
FIGS. 20A and 20B are diagrams for describing the behavior of ink inside the groove due to rotation of the intermediate transfer drum.

FIG. 20A shows a state where the intermediate transfer drum 14 is in a position where preliminary ejection is carried out from the head 50. In the state shown in FIG. 20A, the ink inside the groove 22 is collected in the recess section 44 in the bottom face of the straight section 22C (see FIG. 12) and the recess section 46 in the undercut section 22D (see FIG. 12).

Figure 20B:
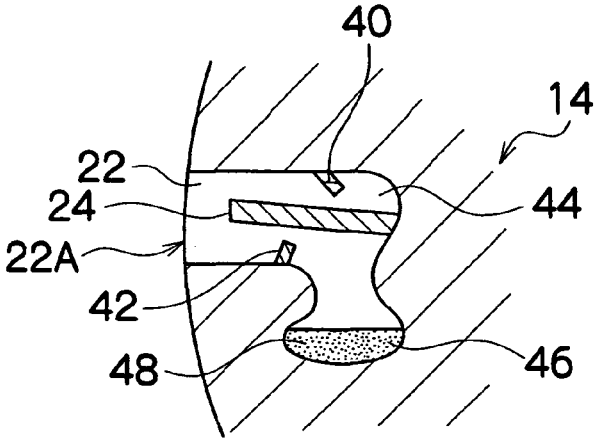

FIG. 20B shows a state where the groove 22 is positioned in the vicinity of the position of the recovery tray 26. When the state shown in FIG. 20A changes to the state shown in FIG. 20B, the ink inside the recess section 44 moves to the undercut section 22D (the recess section 46 and the recess section 48), via the holes 100 and 101 in the second cleaning blade 24.

Figure 20C:
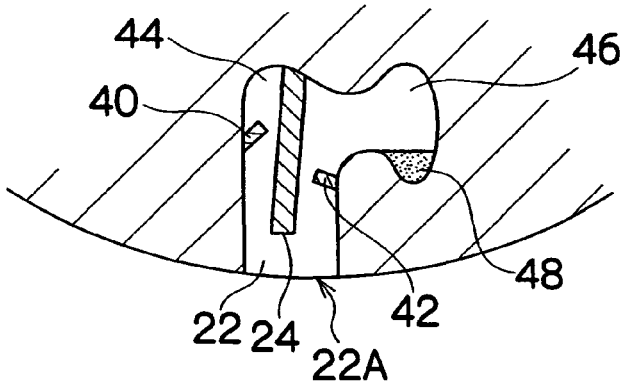

FIG. 20C shows a state where the groove 22 is positioned in the vicinity of the transfer region. In the state shown in FIG. 20C, the opening section 22A of the groove 22 is facing vertically downwards, but the ink inside the groove 22 moves into the recess section 48 in the undercut section 22D, and is held therein, thereby preventing leaking of ink from the opening section 22A. Even supposing that ink is to escape from the recess section 48 due to vibrations during rotation of the intermediate transfer drum 14, for instance, the flow channel of the ink is shut off by the restricting plate 42, and therefore the ink is prevented from passing over the restricting plate 42 and creating ink leakage.

Figure 20D:
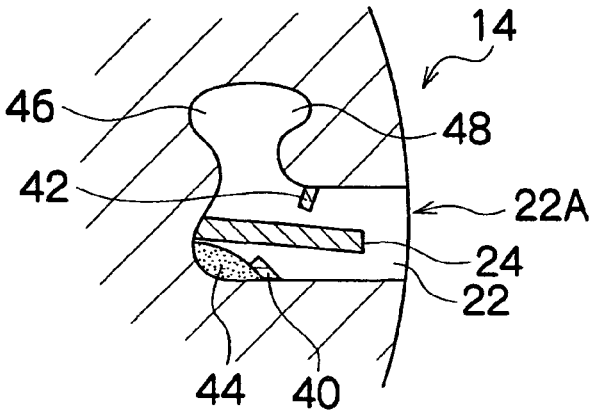

FIG. 20D shows a state where the groove 22 is situated in the vicinity of the position where the first cleaning blade 20 (not illustrated in FIG. 20D; see FIG. 1, and other drawings) is disposed. When the state shown in FIG. 20C changes to the state shown in FIG. 20D, the ink inside the undercut section 22D (recess section 48) moves to the recess section 44 via the holes 100 and 101 in the second cleaning blade 24.

In the state shown in FIG. 20D, the ink moves between the restricting plate 40 and the recess section 44 and is held therein, thereby preventing the occurrence of ink leakage from the opening section 22A.

In other words, as shown in FIGS. 20A to 20D, in the inkjet recording apparatus 10 shown in the present embodiment, even if the intermediate transfer drum 14 is rotated in a state where ink is present inside the groove 22, there is no occurrence of ink leakage from the opening section 22A of the groove 22 provided in the outer circumferential surface of the intermediate transfer drum 14, and the intermediate transfer drum 14 can be rotated while retaining the ink inside the groove 22.

Furthermore, in the cleaning control according to the present embodiment, when the cleaning control terminates, the second cleaning blade 24 is always cleaned by preliminary ejection, and the ink collected in the groove 22 by preliminary ejection is expelled to the recovery tray 26, thereby creating a state where no ink is present inside the groove 22.

Modification Example

Figure 21:
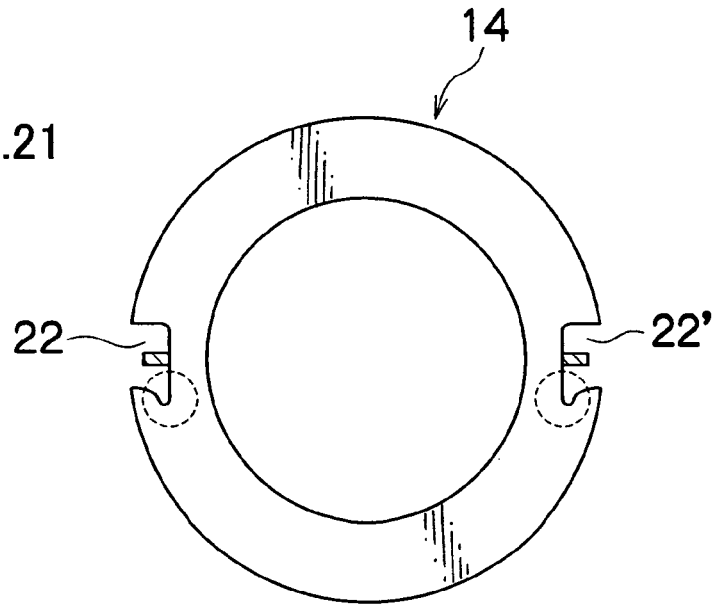
FIG. 21 is a diagram for describing a modification example of the arrangement of the groove shown in FIG. 1.

Next, a modification example of the present embodiment is described below. The embodiment is described above with respect to a mode where only one groove 22 (and one second cleaning blade 24) is provided in the intermediate transfer drum 14, but it is also possible to provide a plurality of grooves. FIG. 21 shows a state where a groove 22' is provided in the intermediate transfer drum 14 on the opposite side from the groove 22 (namely, in a rotationally symmetrical position rotated by 180° degrees about the center of rotation of the intermediate transfer drum 14). According to the mode shown in FIG. 21, in a two-liquid type of inkjet recording apparatus which uses a treatment liquid that cures the ink by reacting with the ink, for example, it is possible to prevent the ink from curing due to reaction between the ink and the treatment liquid inside the groove, by separating the groove which accommodates the ink from the groove which accommodates the treatment liquid.

Furthermore, it is also desirable to provide such a plurality of grooves, since this improves the freedom of the preliminary ejection timing, as well as enabling the first cleaning blade 20 to be cleaned frequently by means of second cleaning blades 24 provided inside the respective grooves.

Furthermore, it is also possible to dispose two grooves in positions which have 180° rotational symmetry about the center of rotation of the intermediate transfer drum 14, and provide two recovery trays in positions having 180° rotational symmetry about the center of rotation of the intermediate transfer drum 14 (for example, by providing a further recovery tray on the opposite side of the intermediate transfer drum 14 from the position of the recovery tray 26 shown in FIG. 1), in such a manner that liquid can be retrieved from the two grooves in a simultaneous fashion.

Figure 22A:
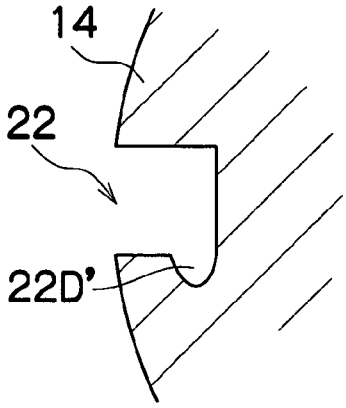
FIGS. 22A and 22B are diagrams for describing modification examples of the shape of the groove shown in FIG. 1.
Figure 22B:
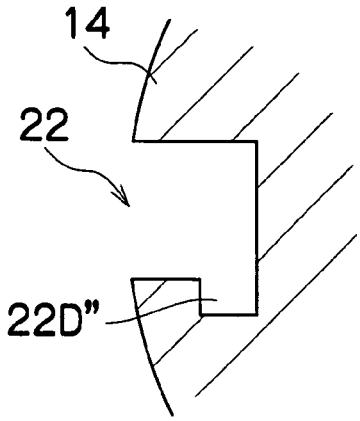

FIGS. 22A and 22B show modification examples of the shape of the groove 22 (the shape of the undercut section 22D). The undercut section 22D" which has a substantially square cross-sectional shape shown in FIG. 22B is more desirable than the undercut section 22D' which has a semicircle-like cross-sectional shape shown in FIG. 22A, since it has a greater ink accommodating capacity. Desirably, the grooves 22 are formed in the intermediate transfer drum 14 by extrusion of an aluminum metal material, or by extrusion of resin.

Figure 23:
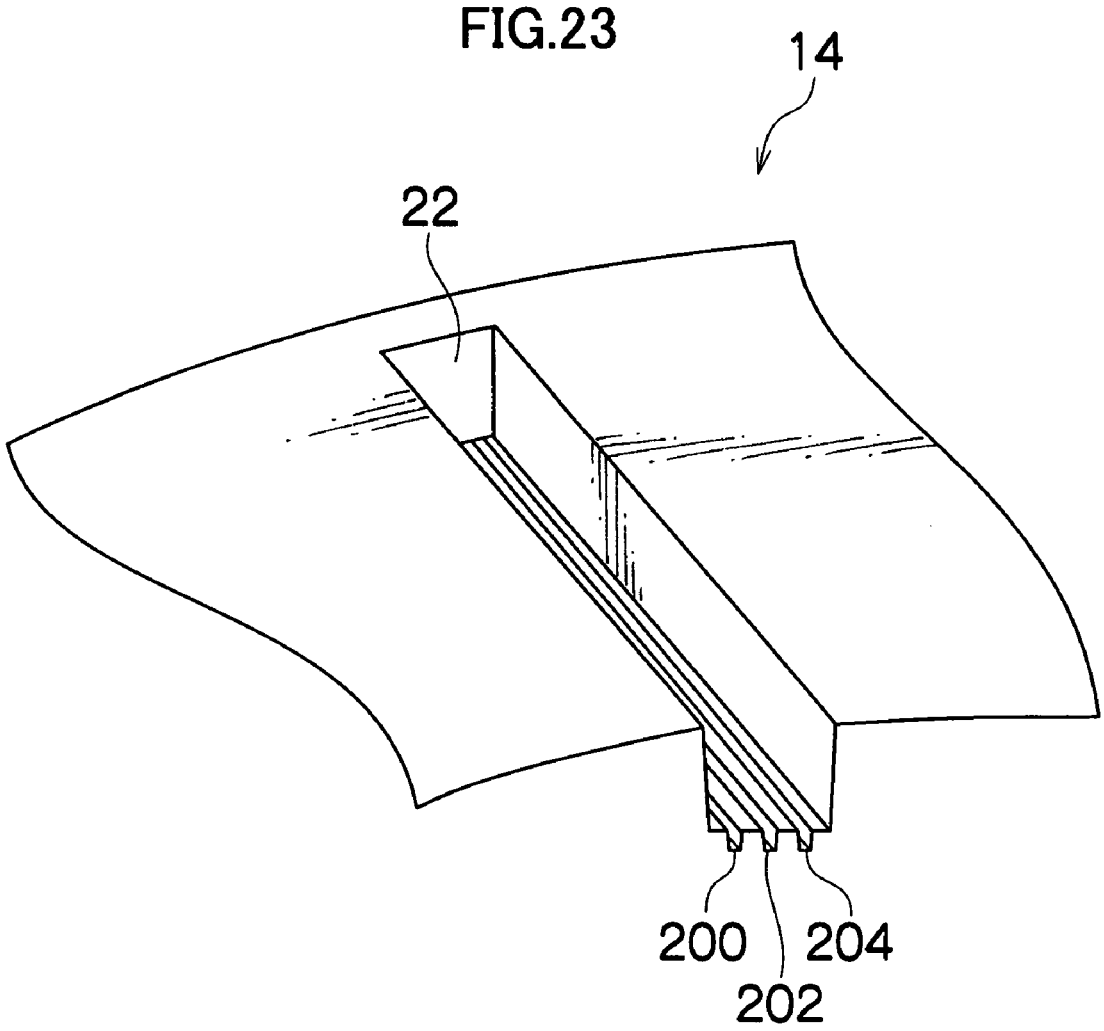
FIG. 23 is a diagram for describing a modification example of the structure of the groove shown in FIG. 1.

FIG. 23 shows a mode where elongated grooves 200, 202 and 204 (second grooves) having a width of approximately 50 μm to 500 μm are provided in the bottom face of the groove 22, in a substantially parallel direction to the direction in which the groove 22 is formed. By forming grooves of even narrower width than the width of the groove 22 in this way, it is possible to retain the ink inside the groove 22 by means of capillary action, regardless of the position of the intermediate transfer drum 14, and therefore the ink is prevented from flowing out of the groove 22.

FIG. 23 shows a mode where the elongated grooves 200, 202 and 204 are provided running in the direction in which the groove 22 is formed, but the direction of forming the elongated grooves 200, 202 and 204 may also be a direction which forms a certain angle with respect to the groove 22. Furthermore, it is also possible to combine grooves of a plurality of types formed in different directions.

According to the inkjet recording apparatus 10 having the composition described above, a groove 22 corresponding to the length of the intermediate transfer drum 14 in the breadthways direction, which is substantially perpendicular to the direction of rotation (movement) of the intermediate transfer drum 14, is provided in the outer circumferential surface of the intermediate transfer drum 14, and a second cleaning blade 24 which makes contact with the first cleaning blade 20 and which removes adhering material attached to the first cleaning blade is provided inside the groove 22, and a composition is adopted in which, after cleaning the first cleaning blade 20, preliminary ejection is carried out toward the second cleaning blade 24, in such a manner that the adhering material attached to the second cleaning blade is washed away by the ink ejected by the preliminary ejection. Therefore, a state is maintained in which there is no adhering material attached to the first and second cleaning blades.

Furthermore, a recovery tray 26 which recovers the ink inside the groove 22 is provided in the vicinity of a side face of the intermediate transfer drum 14, and depending on the amount of ink ejected by preliminary ejection into the groove 22, the groove 22 is moved to the position of the recovery tray 26 and the ink inside the groove 22 is expelled into the recovery tray 26. Therefore, it is possible to prevent the ink from spilling out from the interior of the groove 22.

In the present embodiment, a drum shape is described as one mode of the intermediate transfer body, but the scope of application of the present invention is not limited to an intermediate transfer body having a drum shape, and it is also possible to use an intermediate transfer body having various other shapes, such as a belt shape, a flat plate shape, and the like.

Inkjet recording apparatuses and cleaning methods according to the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

a head which ejects ink droplets;

an intermediate transfer body that has an image forming surface including an image forming region on which an image is formed by means of the ink droplets ejected from the head;

a movement device which moves the intermediate transfer body in a movement direction;

a transfer device which transfers the image formed on the image forming region of the intermediate transfer body to a recording medium;

a first cleaning blade which is provided in a breadthways direction of the intermediate transfer body that is perpendicular to the movement direction, on an upstream side of the head in terms of the movement direction, and which makes contact with the image forming surface of the intermediate transfer body to wipe off and remove adhering material attached to the intermediate transfer body;

a first groove which is provided in the image forming surface of the intermediate transfer body in a direction forming a prescribed angle of $\alpha$ (where $0° < \alpha < 90°$) with respect to the breadthways direction of the intermediate transfer body, the first groove having a circumferential opening in a circumferential face of the intermediate transfer body, the circumferential opening having a length corresponding to a length of the first cleaning blade in a direction perpendicular to the movement direction, the first groove having a side opening in a side face of the intermediate transfer body;

a second cleaning blade which is provided inside the first groove in a direction in which the first groove is formed, throughout the length of the first cleaning blade in the direction perpendicular to the movement direction, the second cleaning blade making contact with the first cleaning blade to remove adhering material attached to the first cleaning blade;

an ejection control device which controls ink ejection from the head in such a manner that preliminary ejection is carried out from the head toward the second cleaning blade to cause adhering material attached to the second cleaning blade to flow into the first groove; and a recovery device which is provided on a downstream side of the head in terms of the movement direction, and which recovers the adhering material removed by the second cleaning blade, collected in the first groove and expelled through the side opening of the first groove; and wherein a bottom face of the first groove is inclined such that the bottom face descends along the breadthways direction of the intermediate transfer body to the side opening in a state where the circumferential opening faces the head.

2. The inkjet recording apparatus as defined in claim 1, wherein:

the first groove includes a straight section having a substantially linear form in a substantially perpendicular direction from the image forming surface of the intermediate transfer body and having a recess section provided in a bottom face of the straight section, and an undercut section connected to the straight section and formed in a direction that is substantially perpendicular to a direction in which the straight section is formed; and the recess section and the undercut section are formed in such a manner that, during the intermediate transfer body being moved, ink in the first groove is retained in at least one of the recess section and the undercut section.

3. The inkjet recording apparatus as defined in claim 2, further comprising a restrictor plate provided on an inner wall face of the straight section of the first groove.

4. The inkjet recording apparatus as defined in claim 1, further comprising a second groove which is provided in a bottom face of the first groove and has a smaller width than a width of the first groove in a direction perpendicular to the direction in which the first groove is formed.

5. The inkjet recording apparatus as defined in claim 1, further comprising a biasing device which presses the first cleaning blade against the image forming surface of the intermediate transfer body to deform the first cleaning blade, in such a manner that relationship between a length $d_0$ in the movement direction of the first groove and a length $d_1$ in the movement direction of a portion of the first cleaning blade which makes contact with the intermediate transfer body satisfies $d_0 > d_1$.

6. The inkjet recording apparatus as defined in claim 1, wherein the first cleaning blade is arranged obliquely at a prescribed angle with respect to the direction in which the first groove is formed.

7. The inkjet recording apparatus as defined in claim 1, wherein the first cleaning blade is an elastic member.

8. The inkjet recording apparatus as defined in claim 1, wherein the first cleaning blade is pushed against the image forming surface of the intermediate transfer body such that the first cleaning blade elastically deforms.

9. The inkjet recording apparatus as defined in claim 1, wherein the second cleaning blade is a rigid member made of one of metal and ceramic.

10. The inkjet recording apparatus as defined in claim 1, wherein the second cleaning blade has a groove in a surface making contact with the first cleaning blade.

11. The inkjet recording apparatus comprising:

a head which ejects ink droplets;

an intermediate transfer body that has an image forming surface including an image forming region on which an image is formed by means of the ink droplets ejected from the head;

a movement device which moves the intermediate transfer body in a movement direction;

a transfer device which transfers the image formed on the image forming region of the intermediate transfer body to a recording medium;

a first cleaning blade which is provided in a breadthways direction of the intermediate transfer body that is perpendicular to the movement direction, on an upstream side of the head in terms of the movement direction, and which makes contact with the image forming surface of the intermediate transfer body to wipe off and remove adhering material attached to the intermediate transfer body;

a first groove which is provided in the image forming surface of the intermediate transfer body in a direction forming a prescribed angle of $\alpha$ (where $0° < \alpha < 90°$) with respect to the breadthways direction of the intermediate transfer body, the first groove having a circumferential opening in a circumferential face of the intermediate transfer body, the circumferential opening having a length corresponding to a length of the first cleaning blade in a direction perpendicular to the movement direction, the first groove having a side opening in a side face of the intermediate transfer body;

a second cleaning blade which is provided inside the first groove in a direction in which the first groove is formed, throughout the length of the first cleaning blade in the direction perpendicular to the movement direction, the second cleaning blade making contact with the first cleaning blade to remove adhering material attached to the first cleaning blade;

an ejection control device which controls ink ejection from the head in such a manner that preliminary ejection is carried out from the head toward the second cleaning blade to cause adhering material attached to the second cleaning blade to flow into the first groove; and a recovery device which is provided on a downstream side of the head in terms of the movement direction, and which recovers the adhering material removed by the second cleaning blade, collected in the first groove and expelled through the side opening of the first groove, wherein:

the first groove has a substantially L-shaped cross-section form along a plane perpendicular to the breadthways direction of the intermediate transfer body;

a bottom face of the first groove is provided with recess sections at both ends in the movement direction; and the first groove has a narrow part between parts adjacent to the recess sections, the narrow part having a width narrower than widths of the parts adjacent to the recess sections.

12. The inkjet recording apparatus as defined in claim 1, wherein the recovery device includes a recovery tray which is arranged adjacently to a position at which the side opening of the first groove exists in a state where the circumferential opening horizontally faces.

* * * * *